US012758016B2

(12) United States Patent
Li

(10) Patent No.: US 12,758,016 B2
(45) Date of Patent: Oct. 13, 2026

(54) FULLY SUPPORT ELECTRIC CHAIR

(71) Applicant: Xiaohua Li, Shanghai (CN)

(72) Inventor: Xiaohua Li, Shanghai (CN)

( * ) Notice: Subject to any disclaimer, the term of this patent is extended or adjusted under 35 U.S.C. 154(b) by 141 days.

(21) Appl. No.: 18/784,194

(22) Filed: Jul. 25, 2024

(65) Prior Publication Data

US 2026/0026623 A1 Jan. 29, 2026

(51) Int. Cl.

| | |
|---|---|
| ***A47C 1/032*** | (2006.01) |
| ***A47C 1/024*** | (2006.01) |
| ***A47C 1/034*** | (2006.01) |
| ***A47C 1/035*** | (2006.01) |

(52) U.S. Cl.

CPC ..... *A47C 1/0242* (2013.01); *A47C 1/03211* (2013.01); *A47C 1/0342* (2013.01); *A47C 1/035* (2013.01)

(58) Field of Classification Search

CPC ..... A47C 1/0342; A47C 1/035; A47C 1/023; A47C 3/40; A61G 5/14; A61G 1/03211

See application file for complete search history.

(56) References Cited

U.S. PATENT DOCUMENTS

| | | | | |
|---|---|---|---|---|
| 4,752,102 | A * | 6/1988 | Rasmussen | A47C 3/24 187/244 |
| 4,966,413 | A * | 10/1990 | Palarski | A47C 7/38 297/284.6 |
| 7,380,881 | B2 * | 6/2008 | Freed | A47C 1/023 297/337 |
| 7,922,249 | B2 * | 4/2011 | Marchand | A47B 83/001 297/148 |
| 9,215,934 | B2 * | 12/2015 | Lee | A61F 5/00 |
| 10,369,066 | B2 * | 8/2019 | Spence | A61G 5/1059 |
| 10,874,574 | B1 * | 12/2020 | Ruby | A61G 15/02 |
| 11,173,081 | B2 * | 11/2021 | Mulhern | A47C 1/035 |
| 12,053,424 | B2 * | 8/2024 | Kang | A61H 9/0078 |
| 12,478,192 | B2 * | 11/2025 | Liu | A47C 1/0342 |
| 2004/0080190 | A1 * | 4/2004 | Markwald | A61G 5/1064 297/61 |
| 2010/0320809 | A1 * | 12/2010 | Roleder | A47C 1/0242 297/69 |
| 2021/0205157 | A1 * | 7/2021 | Nathan | A61G 5/107 |
| 2025/0072566 | A1 * | 3/2025 | ten Cate | A43D 1/02 |

FOREIGN PATENT DOCUMENTS

| | | | | |
|---|---|---|---|---|
| CN | 107348729 | A * | 11/2017 | A47C 1/0342 |
| CN | 110916397 | A * | 3/2020 | A47C 1/03211 |
| CN | 111387740 | A * | 7/2020 | A47C 1/03211 |

(Continued)

*Primary Examiner* — Timothy J Brindley

(57) ABSTRACT

A fully support electric chair is disclosed. The electric chair, in an embodiment includes a chassis, a lifting fixed frame, a lifting and moving frame, a flip frame, seat moving frame, backrest frame, an armrest part and a legrest system. Wherein the lifting fixed frame is fixed on the chassis. The lifting and moving frame are mounted on the lifting fixed frame and could be moved up and down. The backrest frame and the flip frame are connected to the lifting and moving frame through an axis, and are rotated around the axis at a certain angle under the push of an electric push rod. The chair's entire structure allows for height adjustment, backrest flipping, seat cushion flipping, seat cushion moving forward and backward, and leg rest rotation.

7 Claims, 30 Drawing Sheets

(56) References Cited

FOREIGN PATENT DOCUMENTS

| | | | | | |
|---|---|---|---|---|---|
| CN | 112057249 | A | * | 12/2020 | A61G 5/10 |
| CN | 112089542 | A | * | 12/2020 | A61G 5/006 |
| CN | 112155876 | A | * | 1/2021 | A61G 5/14 |
| CN | 113712391 | A | * | 11/2021 | A47C 7/462 |
| CN | 113797029 | A | * | 12/2021 | A61G 5/125 |
| CN | 113876500 | A | * | 1/2022 | A61G 5/14 |
| CN | 116919104 | A | * | 10/2023 | A47C 7/46 |
| DE | 20118372 | U1 | * | 1/2002 | A47C 1/0355 |
| DE | 102014109014 | A1 | * | 12/2015 | A47C 1/023 |
| GB | 2588447 | A | * | 4/2021 | A61G 5/14 |
| WO | WO-2023046239 | A1 | * | 3/2023 | A47C 1/0355 |

* cited by examiner

FULLY SUPPORT ELECTRIC CHAIR

FIELD OF THE INVENTION

The present application relates to chairs. More specifically, the present application relates to a fully support electric chair.

BACKGROUND

As society and technology continue to advance, there is a growing demand for more adaptable seating. Traditional seats have fixed heights and angles that cannot be adjusted to suit individual needs. This limitation prevents people from sitting comfortably and can lead to poor posture and health issues, especially for children and long-term office workers. To address this problem, a new invention incorporates 5 sets of push rods to allow for convenient adjustments to the seat cushion, backrest, and leg support. This application enables users to achieve any required posture, meeting the diverse needs of different individuals and the same person at various times.

SUMMARY

In various embodiments, a fully support electric chair that can solve the shortcomings of the above technology, is provided.

As shown in FIGS. 1-3, the fully support electric chair comprising a chassis 100, a lifting fixed frame 200, a lifting and moving frame 300, an angle adjustment frame 400, seat moving frame 500, backrest frame 600, an armrest part 700 and a legrest system 800. Wherein the lifting fixed frame 200 is fixed on the chassis 100. The lifting and moving frame 300 is mounted on the lifting fixed 200 frame and could be moved up and down. The backrest frame 600 and the angle adjustment frame 400 are connected to the lifting and moving frame 300 through an axis, and are rotated around the axis at a certain angle under the push of an electric push rod. The seat moving frame 500 is mounted on the angle adjustment frame and can slide forward and backward along the seat moving frame 400. The armrest part 700 could be lowered or raised following the rotation of the backrest frame 600. The legrest system 800 is connected to the seat moving frame 500 through an axis. It can rotate to a certain angle under the action of the electric push rod and move forward and backward with the seat moving frame 500. The chair's entire structure allows for height adjustment, backrest angle adjustment, seat cushion angle adjustment, seat cushion moving forward and backward, and leg rest rotation. This enables the chair to accommodate different postures and meet the needs of various users.

Wherein, as shown in FIGS. 1-3, the chassis 100 comprising a chassis frame 101 and casters 102. Casters 102 are mounted on the four corners of the chassis frame 101. The electric control box 103 is mounted on the chassis frame 101.

Wherein, as shown in FIGS. 1, 2, 4 and 5, the lifting fixed frame 200 comprising a support beam 201, a supporting sub-frame 202, a lifting fixed column 203, a front extension beam 204, a rear extension beam 205, a lateral support beam 206, a nut 207 and a lifting column connection block 208. The support beam 201, the supporting sub-frame 202, the front extension beam 204, the rear extension beam 205 and the lateral support beam 206 are welded together to form a supporting frame.

Wherein, as shown in FIGS. 1, 2 and 6-9, the lifting and moving frame 300 comprising a top longitudinal beam 301, a top longitudinal sub-beam 302, a lifting column 303, a lateral support sub-frame 304, a longitudinal bottom support beam 305, a backrest push rod motor end support plate 306, a built-in connection block 307, a motor base 308, a lifting motor 309, a lead screw with gearbox 310, a seat flip push rod support shaft 311, a left and right power transmission shaft 312, a front and rear screw drive shafts 313, an armrest support shaft 314, a reinforcement rod 315, a seat flip push rod 316 and backrest flip push rod 317. Wherein the lifting column 303, the lateral support sub-frame 304, the longitudinal bottom support beam 305 and the reinforcement rod 315 are welded together to form a supporting frame. The built-in connection block 307 is installed to both sides of the upper end of the lifting column 303 by bolts, and then the top longitudinal beam 301 and the top longitudinal sub-beam 302 are connected to the built-in connection block 307 to form an overall frame, the backrest push rod motor end support plate 306 is welded to the lateral support sub-frame 304, the motor base 308 is installed to the lifting and moving column 303, the lifting motor 309 is installed to the motor base 308, the lead screw with gearbox 310 is fixed to the top longitudinal main beam 301 and the top longitudinal sub-beam 302 by bolts and inserted into the lifting and moving column 303, the seat flip push rod support shaft 311 passes through the seat flip push rod 316. The motor end is installed on the longitudinal bottom support beam 305, the left and right power transmission shaft 312 are connected to the front and rear screw drive shafts 313 through the gear box, and the front and rear screw drive shafts 313 are simultaneously. The armrest support shaft 314 passes through the lifting motor 309 and the lead screw with gearbox 310, and is respectively welded to the top longitudinal beam 301 and the top longitudinal sub-beam 302. One end of the backrest flip push rod 317 is connected to the backrest push rod motor end support plate 306 through a shaft.

Wherein, as shown in FIGS. 1, 2, 10 and 11, the angle adjustment frame 400 comprising a lip frame main beam 401, a seat moving push rod fixed support beam 402, a seat flip push rod ear plate 403, an ear plate support beam 404 and a seat moving push rod. The angle adjustment frame main beam 401, the seat moving push rod fixed support beam 402, the seat flip push rod ear plate 403, and the seat moving push rod 405 are welded into a frame. The ear plate support beam 404 is welded to the seat moving push rod 405.

Wherein, as shown in FIGS. 1, 2, 9, 12, 13 and 14, the seat moving frame 500 comprising a moving frame main beam 501, a seat support beam 502, a leg support beam 503, a moving ear plate support beam 504, a friction plate 505, a secondary friction plate 506, a remove transition plate 507, a front reinforcement beam 508, a rear reinforcement beam 509, a moving lug plate 510, a leg support push rod fixing lug plate 511, a push rod shaft 512, a leg support connecting shaft 513, a seat cushion 514 and a leg support flip push rod 515. The moving frame main beam 501 of the mobile frame, the front reinforcement beam 508, and the rear reinforcement beam 509 are welded to form a support frame. The seat support beam 502 and the moving ear plate support beam 504 are bolted to the moving frame main beam 501 of the mobile frame through the friction plate 505. The remove transition plate 507 is welded to the leg support beam 503 to form a detachable frame and then connected to the moving frame main beam 501 of the mobile frame by bolts. The secondary friction plate 506 is installed on the leg support beam 503. The moving lug plate 510 is welded to the moving ear plate support beam 504, the leg support push rod fixing lug plate 511 is welded to the leg support beam 503, the leg support connecting shaft 513 passes through the front opening of the mobile frame moving frame main beam 501, the push rod shaft 512 is installed in the middle of the leg support push rod fixing lug plate 511, the seat cushion 514 is installed on the seat support beam 502 and the moving ear plate support beam 504, and the leg support flip push rod 515 is installed on the push rod shaft 512.

Wherein, as shown in FIGS. 1, 2, 15 and 16, the backrest frame 600 comprising a lower backrest airbag cushion 601, an upper backrest cushion 602, an airbag headrest 603, a vertical backrest support beam 604, a backrest rotation axis 605, an armrest support rod 606, a horizontal reinforcement beam 607 and push rod ear plate at the flip end of the backrest 608. The vertical backrest support beam 604 and the horizontal reinforcement beam 607 are welded to form a support frame, the armrest support rod 606 is welded to the vertical backrest support beam 604, the lower backrest airbag cushion 601 and the upper backrest cushion 602 are installed on the support frame, the airbag headrest 603 is pressed on the upper backrest cushion 602, the backrest rotation axis 605 is installed on the vertical backrest support beam 604, and the push rod ear plate at the flip end of the backrest 608 is welded to the horizontal reinforcement beam 607.

Wherein, as shown in FIGS. 1, 2 and 17, the armrest part 700 comprising a vertical armrest support rod 701, a horizontal armrest support rod 702 and an armrest plate 703. The horizontal armrest support rod 702 is installed on the vertical armrest support rod 701, and the horizontal armrest support rod 702 and the vertical armrest support rod 701 are hinged.

Wherein, as shown in FIGS. 1, 2, 18-20, the legrest system 800 comprising a motor push rod fixing plate 801, a legrest main frame support beam 802, a legrest main frame reinforcement plate 803, a rotation support beam 804, a leg support end push rod ear plate 805, a main cross brace of leg support main frame 806, a secondary cross brace of leg support main frame 807, an anti-snap plate 808, a main beam of leg support moving frame 809, a transverse reinforcement beam of leg support moving frame 810, a push rod moving end fixing sleeve 811, a push rod moving end fixing plate 812, a foot support plate 813, a transverse reinforcement beam of foot support 814, an intermediate reinforcement beam of foot support 815, a leg support pad 816, a push rod motor 817 and a push rod 818. The legrest main frame reinforcement plate 803, the legrest main frame support beam 802 the main cross brace of leg support main frame 806, and the secondary cross brace of leg support main frame 807 are welded to form a fixed frame, the motor push rod fixing plate 801 is installed on the fixed frame, the push rod motor 817 and the push rod 818 head are installed on the motor push rod fixing plate 801, the rotation support beam 804 is welded to the main cross brace of leg support main frame 806, the leg support end push rod ear plate 805 is welded to the secondary cross brace of leg support main frame 807, and the anti-snap plate 808 is welded to the main cross brace of leg support main frame 806. On the legrest main frame support beam 802, the main beam of leg support moving frame 809 and the transverse reinforcement beam of leg support moving frame 810 are welded together to form a movable frame. At the same time, the main beam of leg support moving frame 809 is inserted into the legrest main frame support beam 802 to form a telescopic movement. The push rod moving end fixing plate 812 is welded to the head of the push rod moving end fixing sleeve 811, the foot support plate 813, the transverse reinforcement beam of foot support 814, and the intermediate reinforcement beam of foot support 815 are welded to form a foot frame, and the leg support pad 816 is installed on the secondary cross brace of leg support main frame 807.

Beneficial Effects of this Application

1. Suitable for different chair postures of various users.
2. Provides full support for head, neck, back, waist, thighs, calves and feet.
3. Electric control is convenient for users to operate, and it has a memory function for easy use.
4. Meets the requirements of office, home, study, entertainment, and rest, promoting correct sitting posture.
5. Allows users to achieve a zero gravity position.

BRIEF DESCRIPTION OF THE DRAWINGS

The technology may be more completely understood in connection with the following drawings, in which:

As shown in FIG. 1-30:

Figure 1:
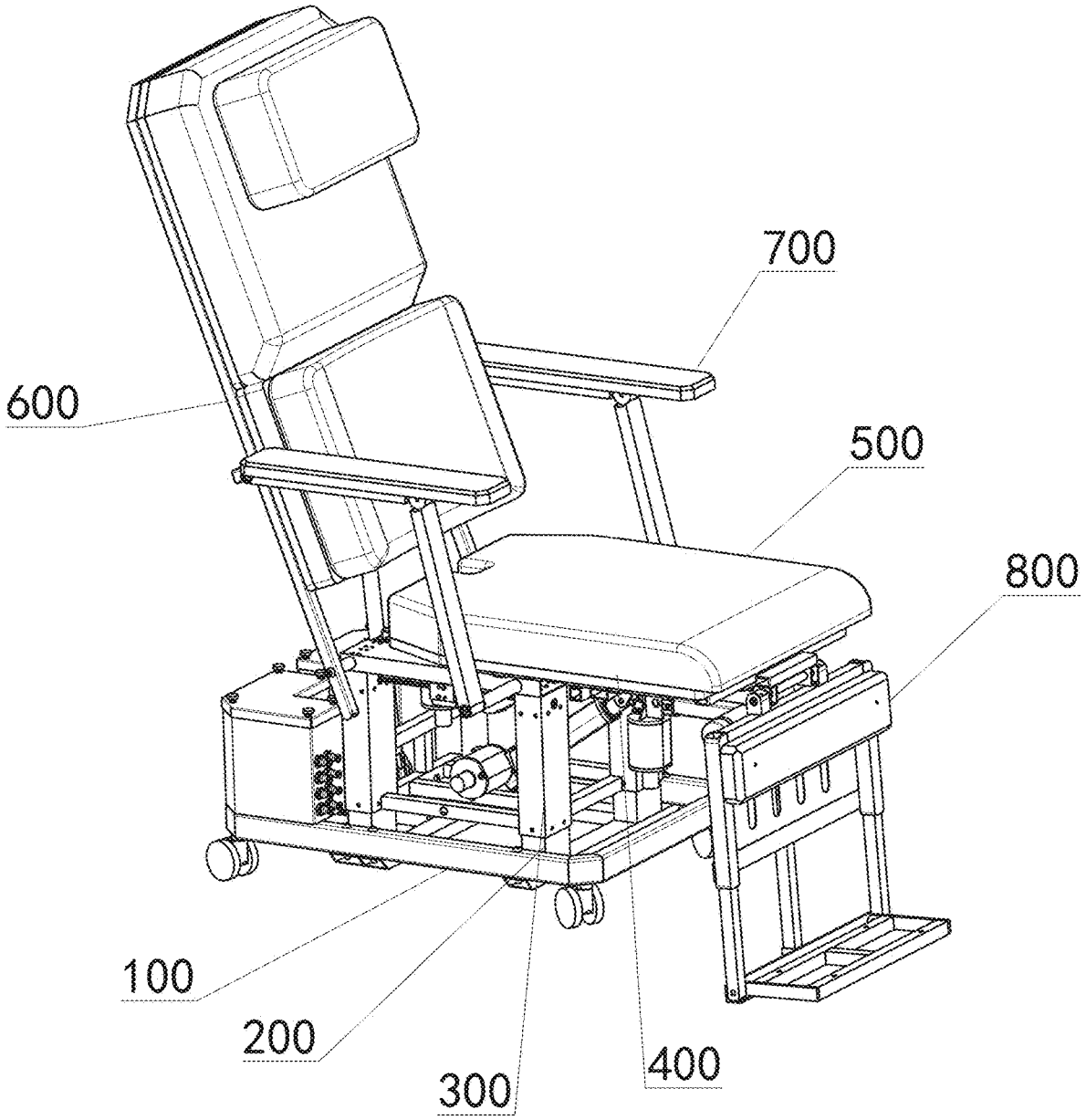
FIG. 1 is a perspective view of a fully support electric chair, according to an embodiment.
Figure 2:
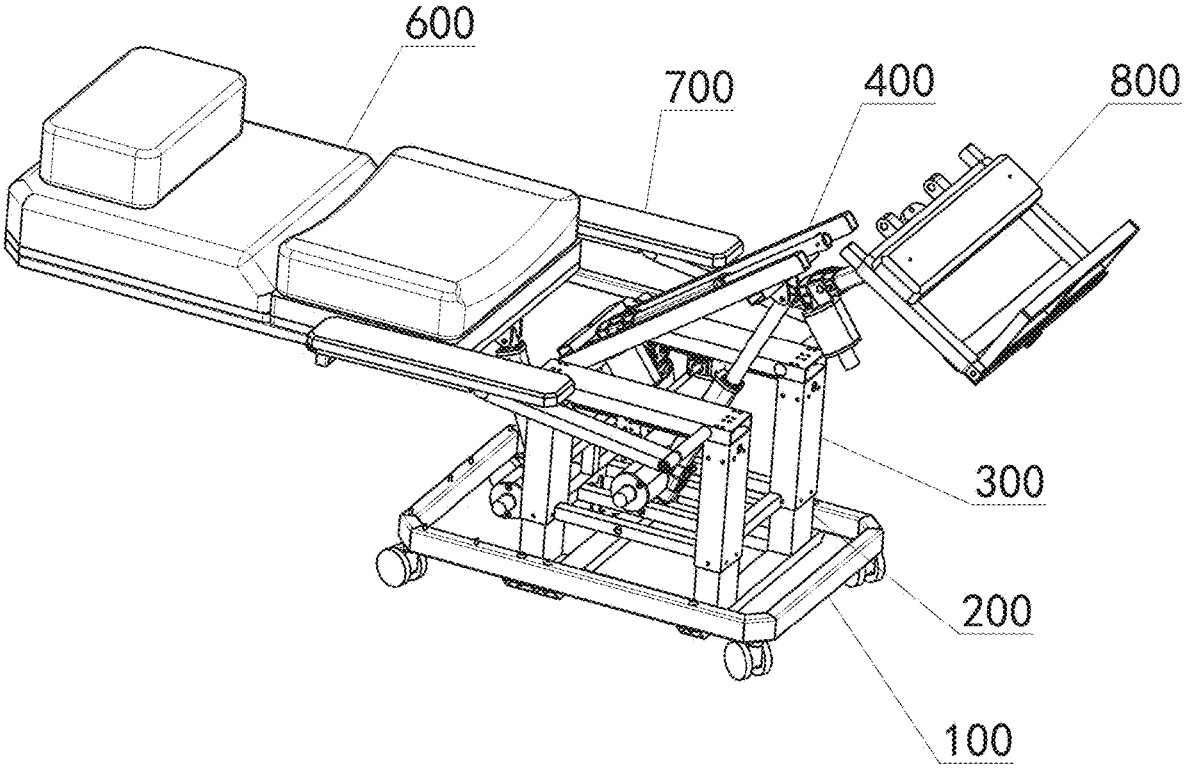
FIG. 2 is a perspective view of a fully support electric chair without seat cushion, according to an embodiment.
Figure 3:
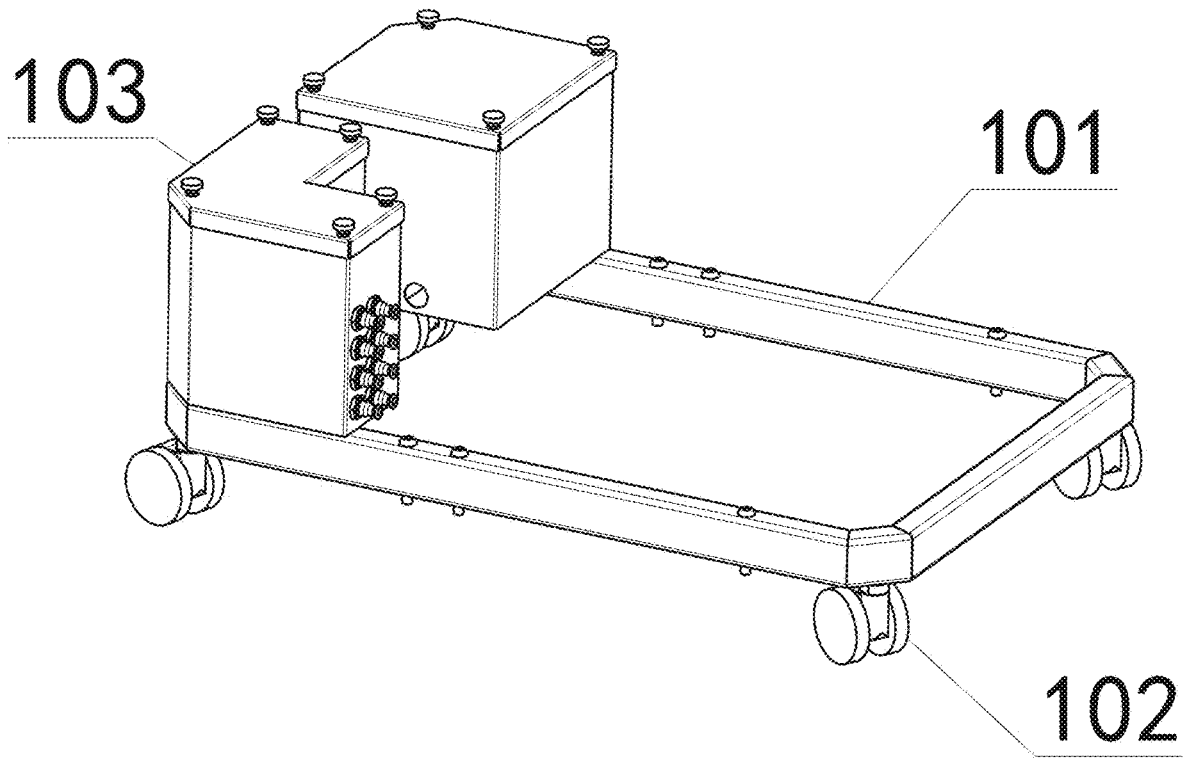
FIG. 3 is a perspective view of a chassis, according to an embodiment.
Figure 4:
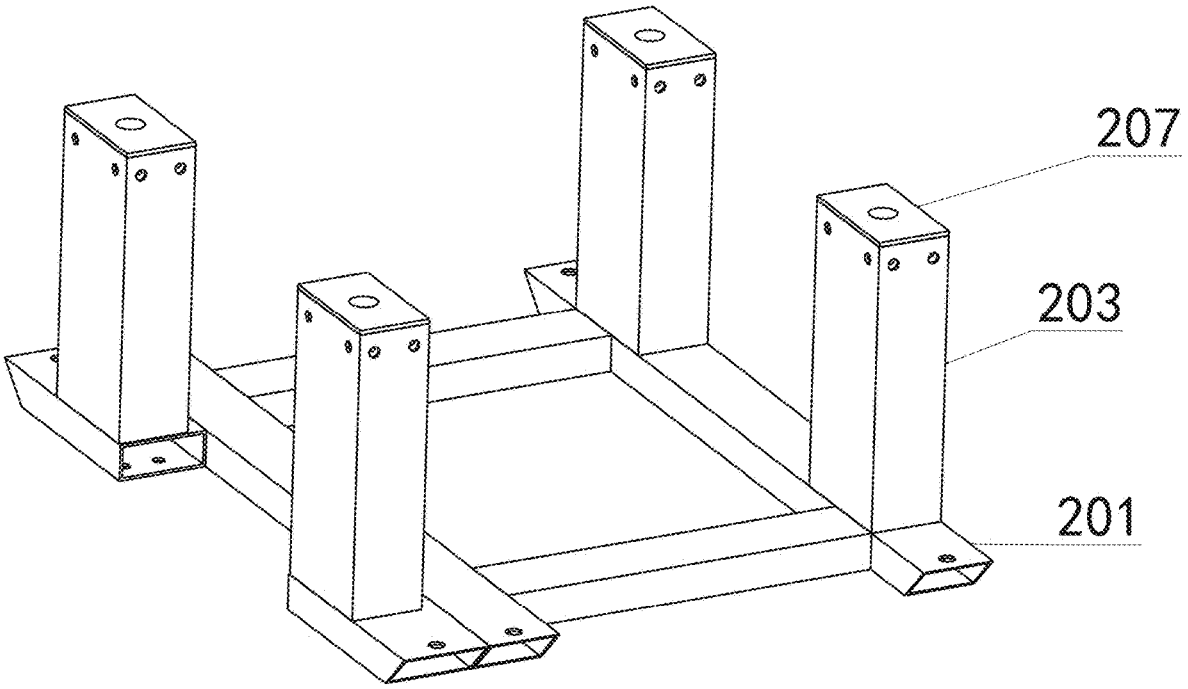
FIG. 4 is a perspective view of a lifting fixed frame, according to an embodiment.
Figure 5:
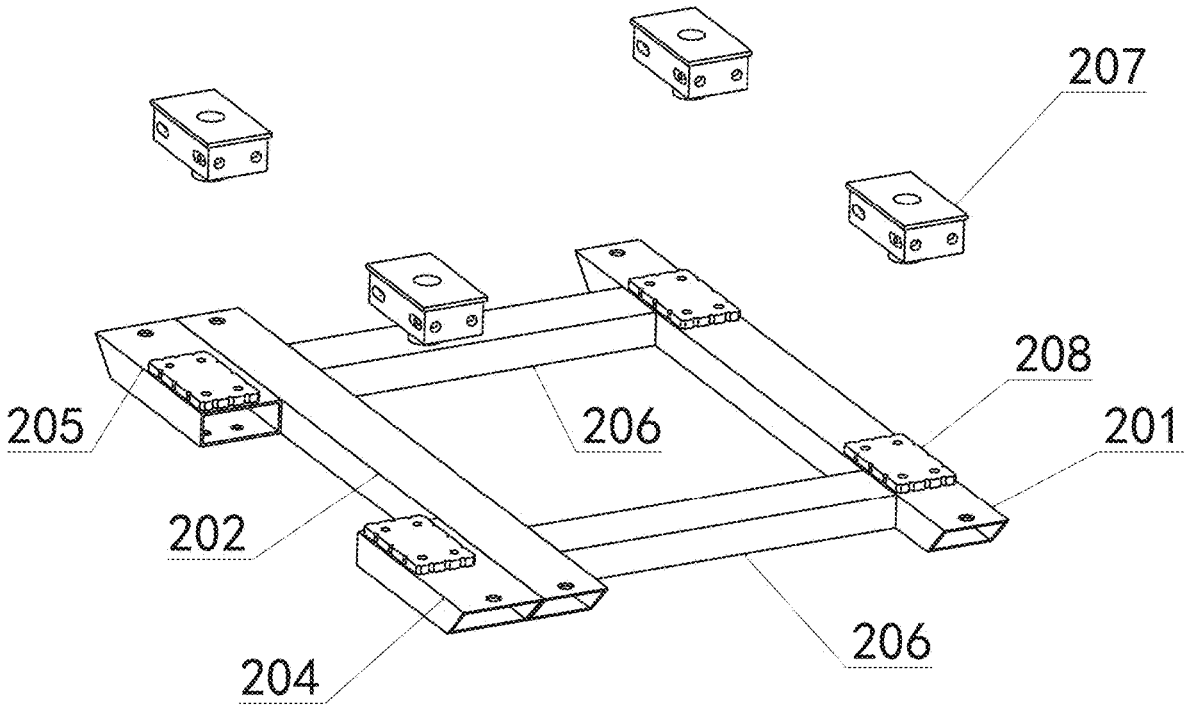
FIG. 5 is a perspective view of inner part of a lifting fixed frame, according to an embodiment.
Figure 6:
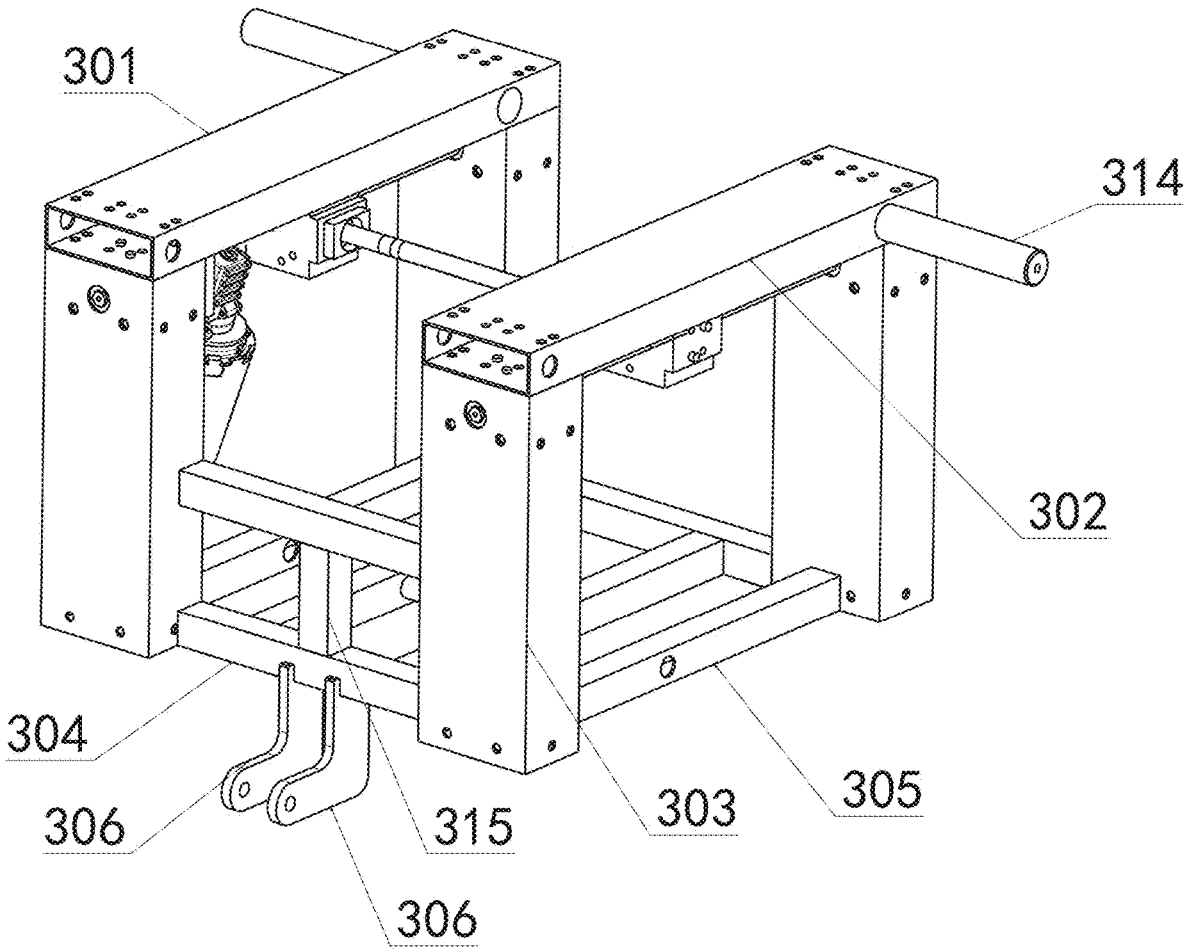
FIG. 6 is a perspective view of a lifting and moving frame, according to an embodiment.
Figure 7:
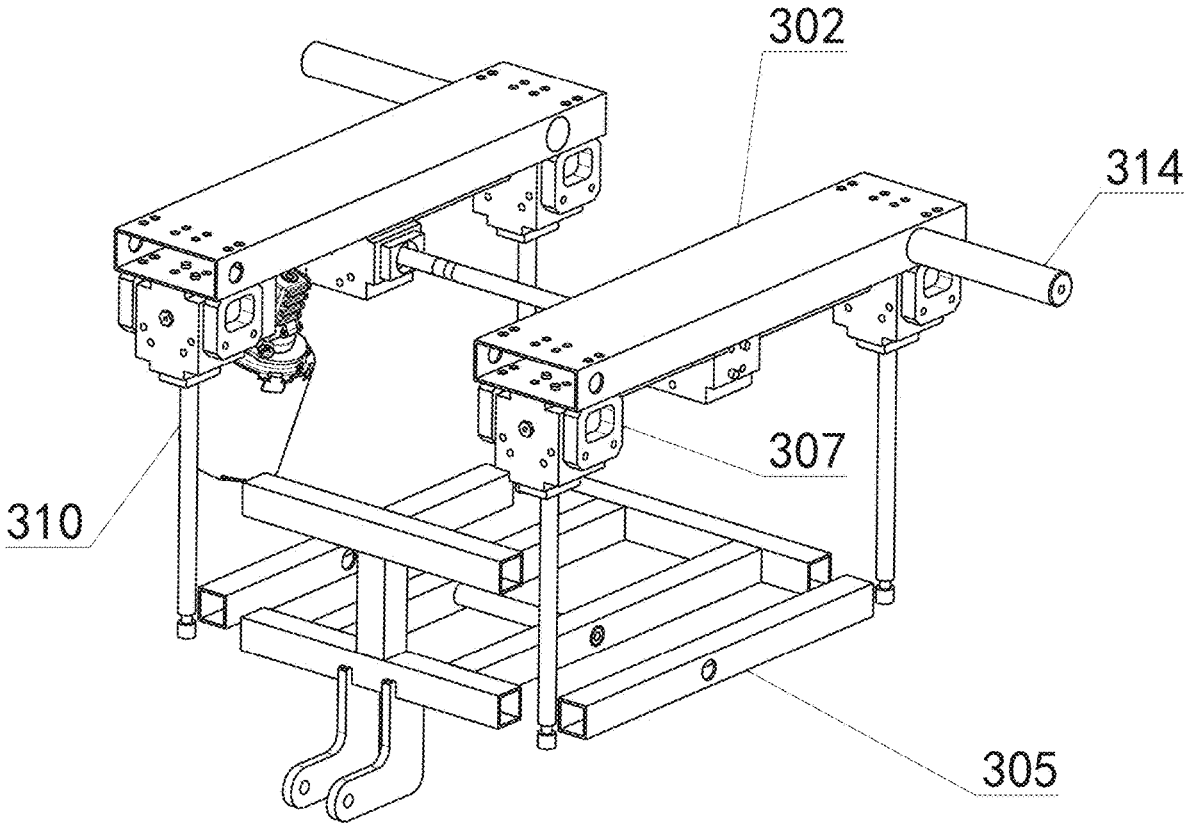
FIG. 7 is a perspective view of inner part of a lifting and moving frame, according to an embodiment.
Figure 8:
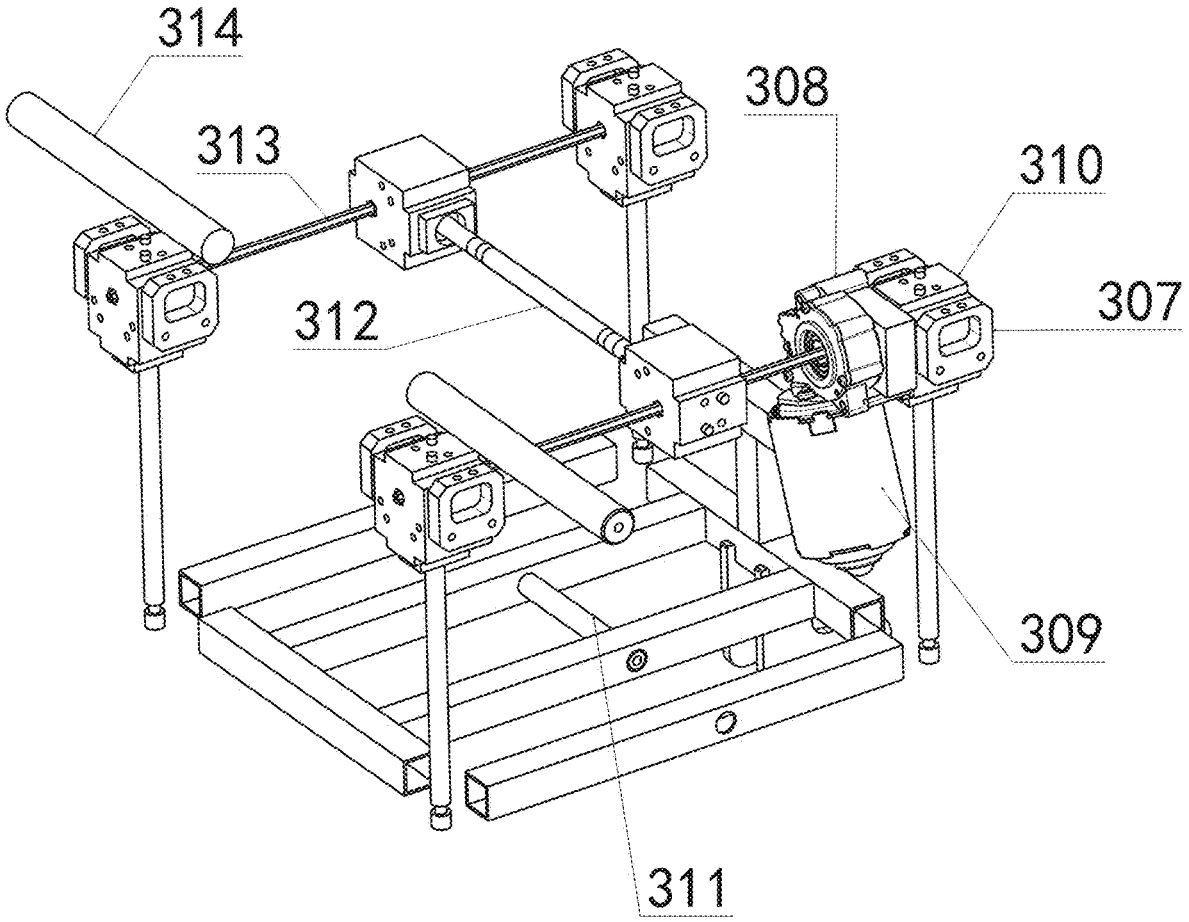
FIG. 8 is another perspective view of inner part of a lifting and moving frame, according to an embodiment.
Figure 9:
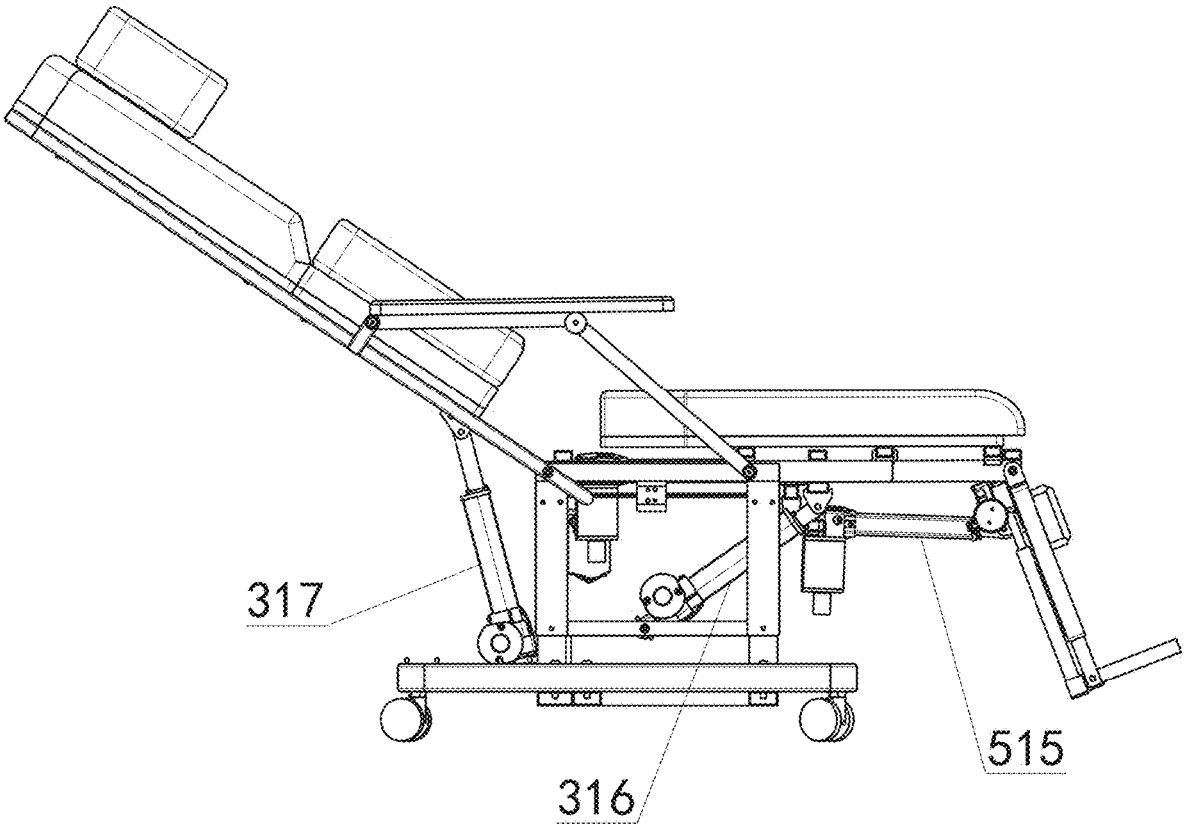
FIG. 9 is a perspective view of a push rod, according to an embodiment.
Figure 10:
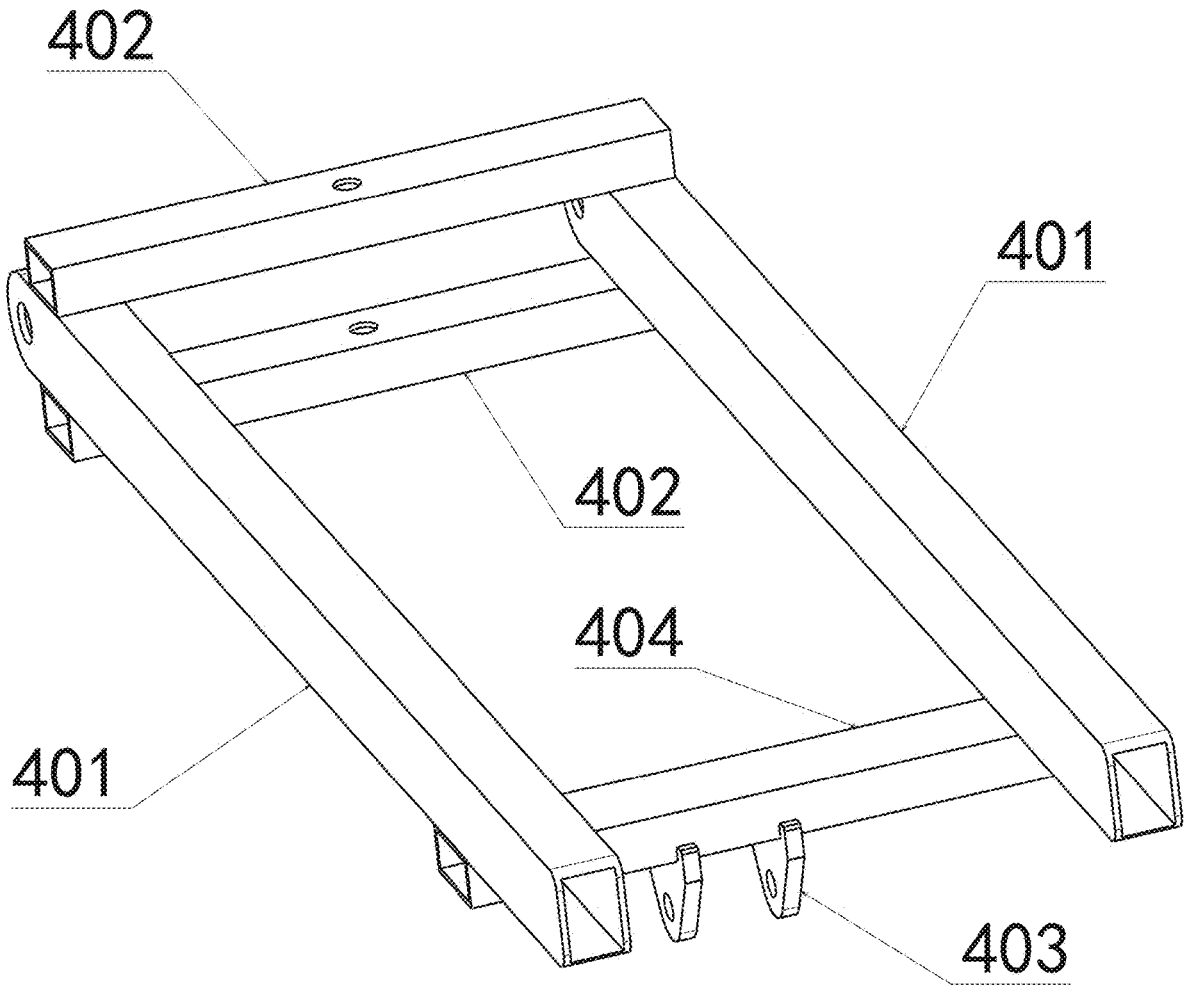
FIG. 10 is a perspective view of an angle adjustment frame, according to an embodiment.
Figure 11:
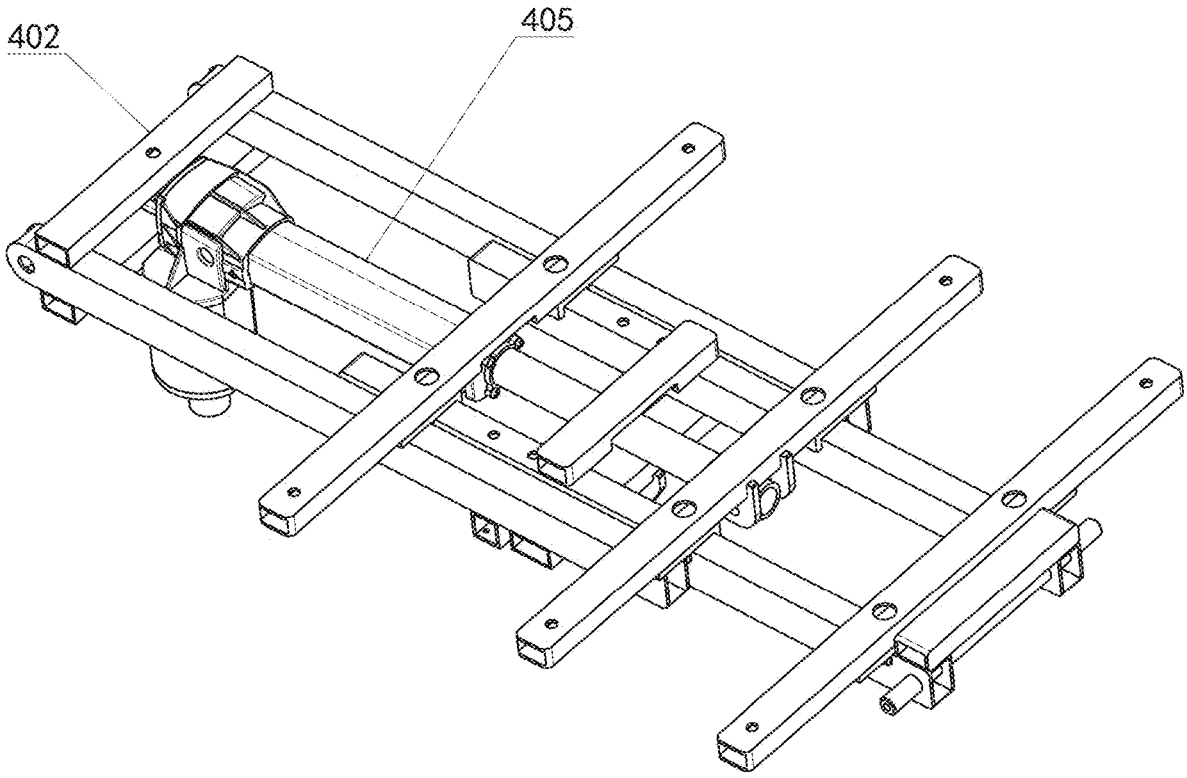
FIG. 11 is a perspective view of a flip push rod, according to an embodiment.
Figure 12:
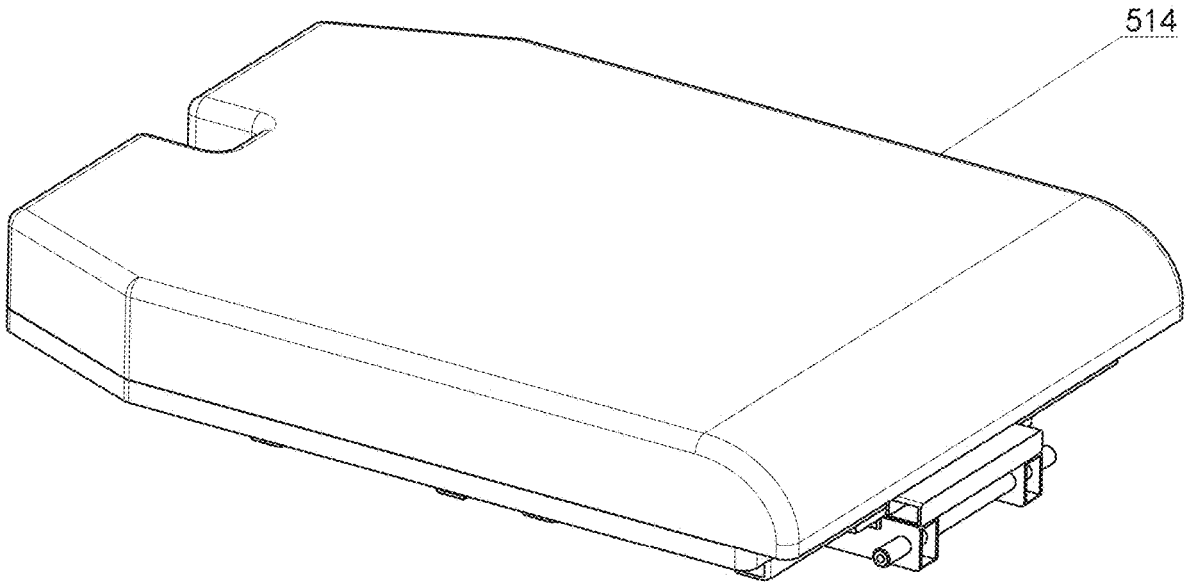
FIG. 12 is a perspective view of a seat moving frame, according to an embodiment.
Figure 13:
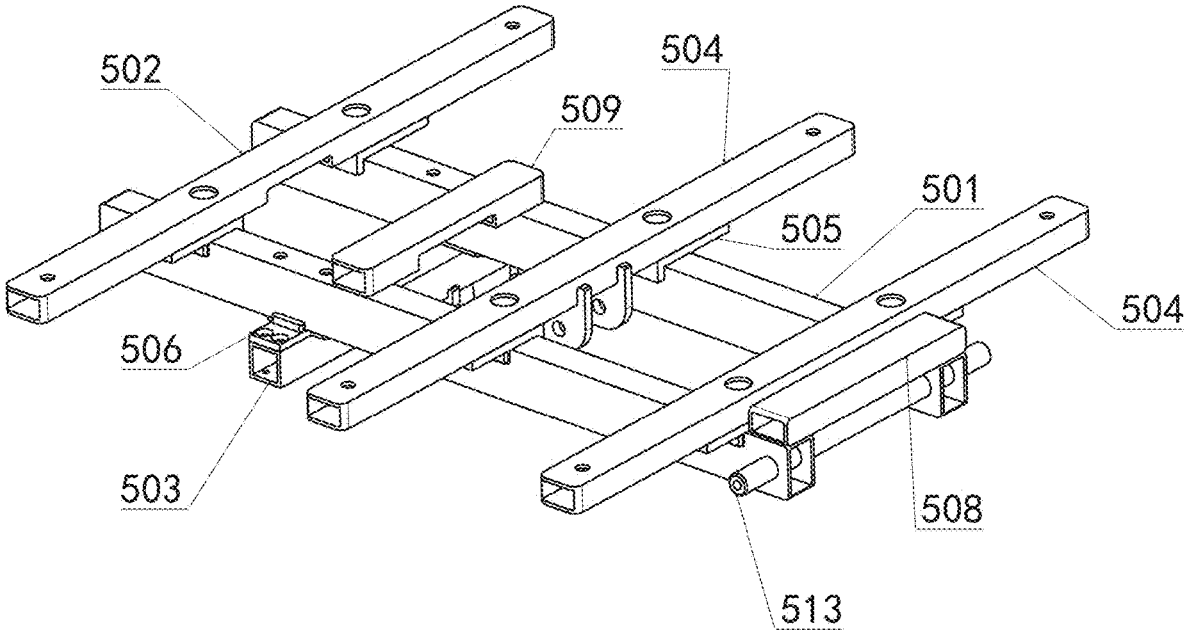
FIG. 13 is a perspective view of a Seat flip push rod, according to an embodiment.
Figure 14:
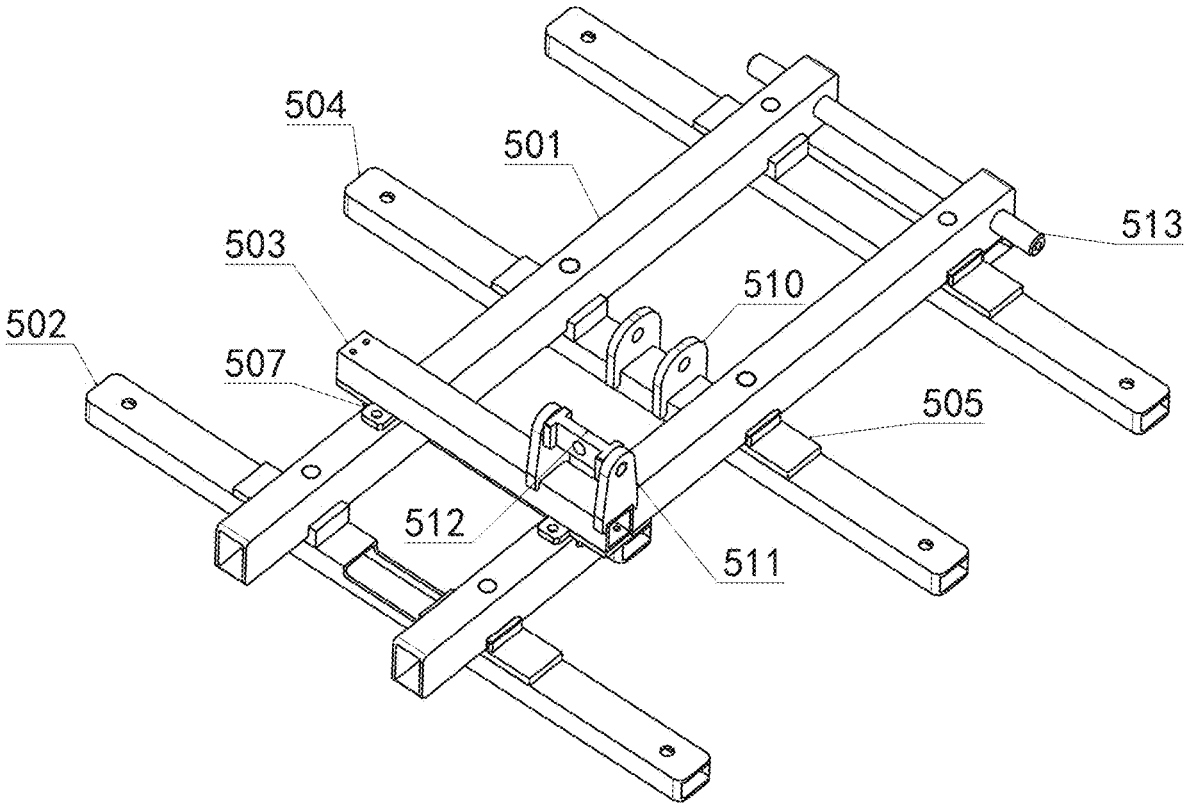
FIG. 14 is a perspective view of a Seat moving frame back, according to an embodiment.
Figure 15:
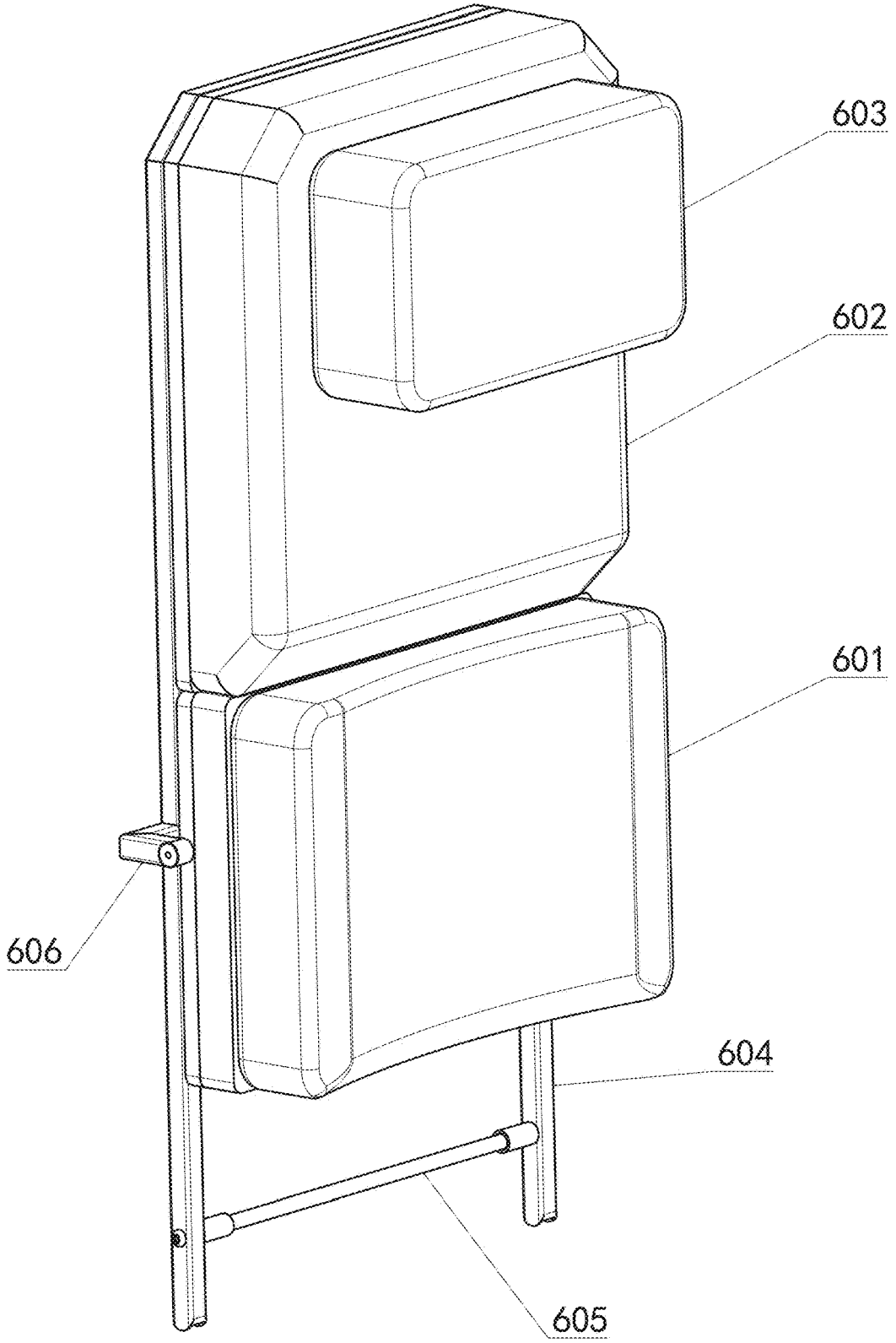
FIG. 15 is a perspective view of a Backrest frame, according to an embodiment.
Figure 16:
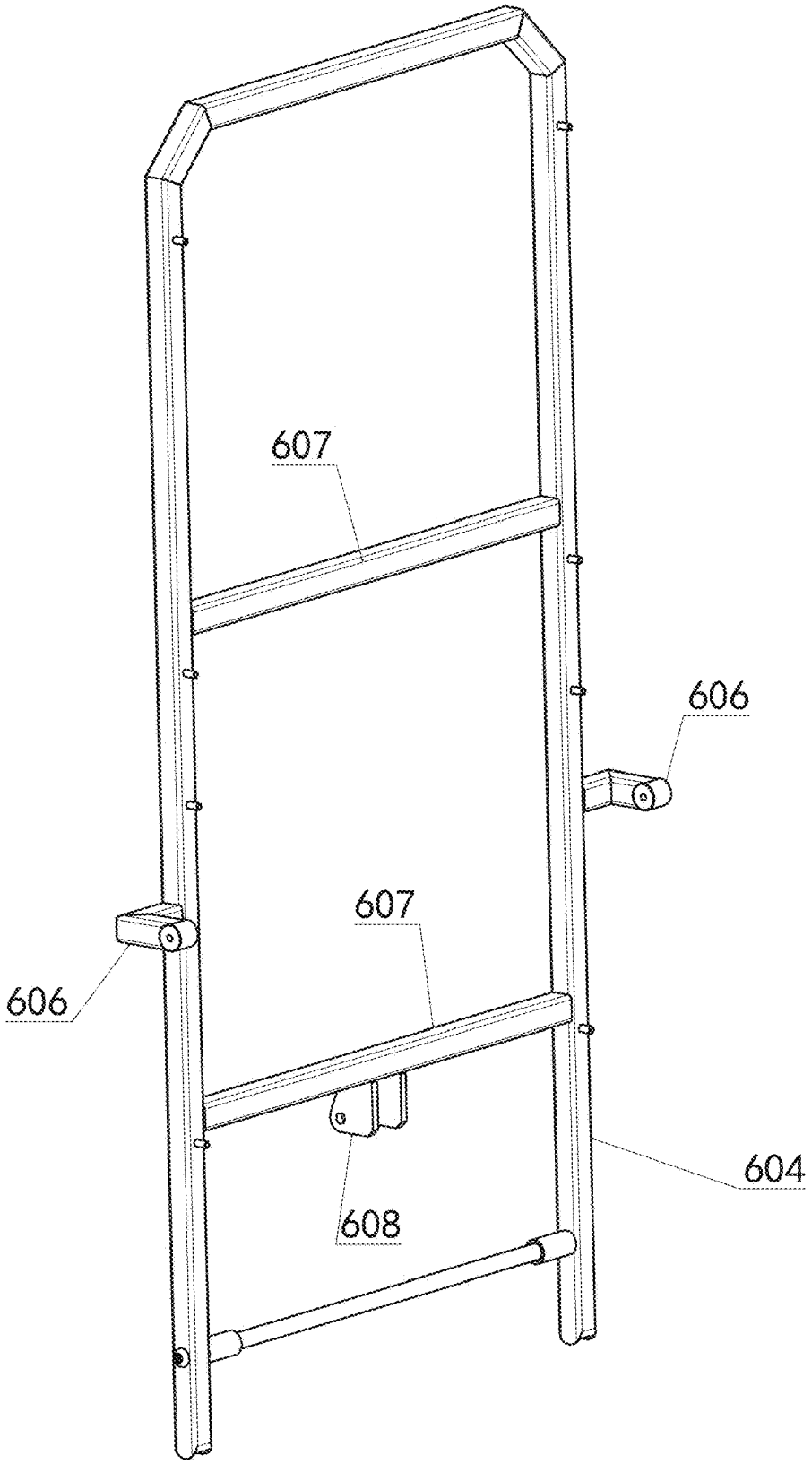
FIG. 16 is another perspective view of a Backrest frame, according to an embodiment.
Figure 17:
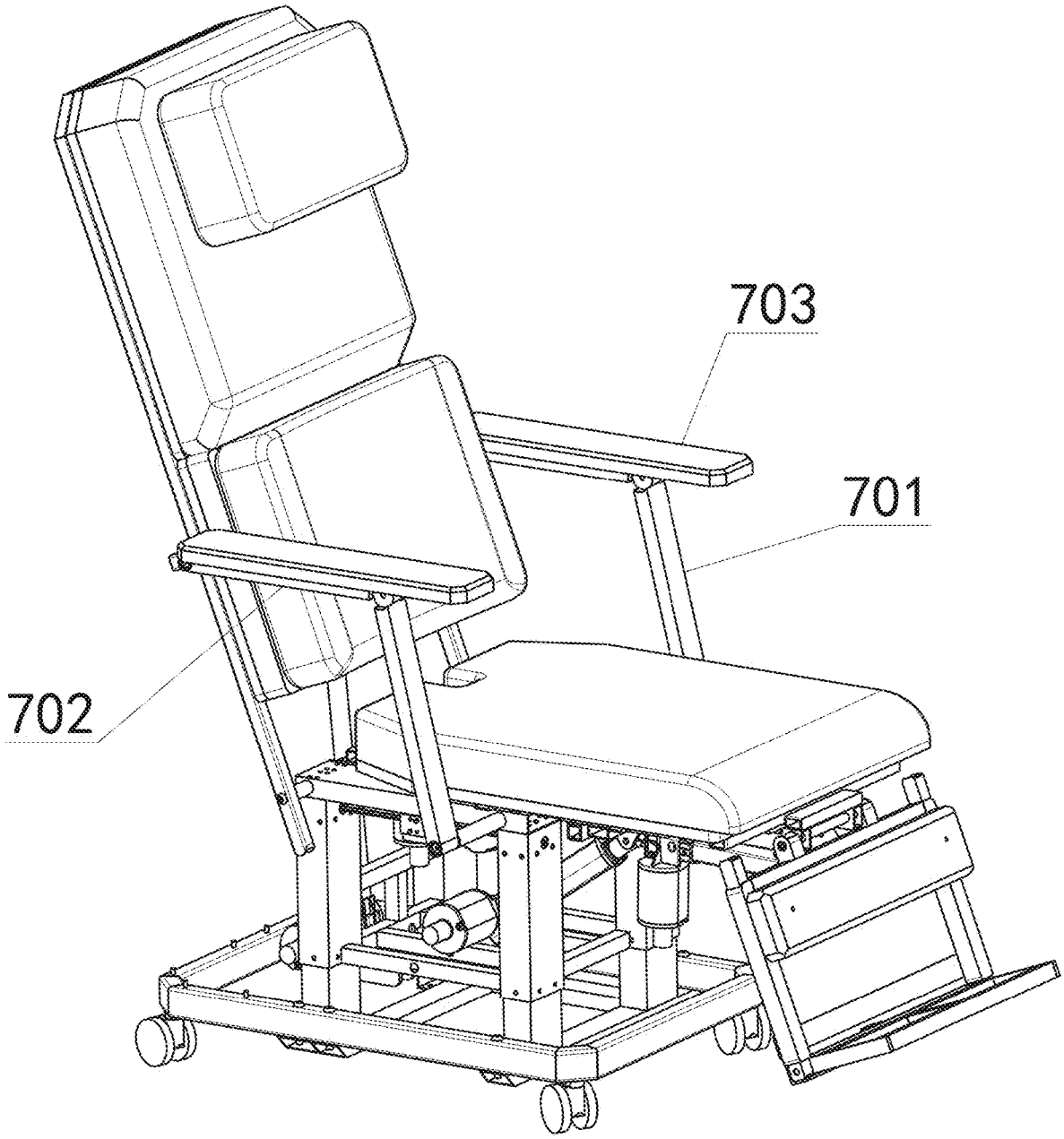
FIG. 17 is a perspective view of an Armrest part, according to an embodiment.
Figure 18:
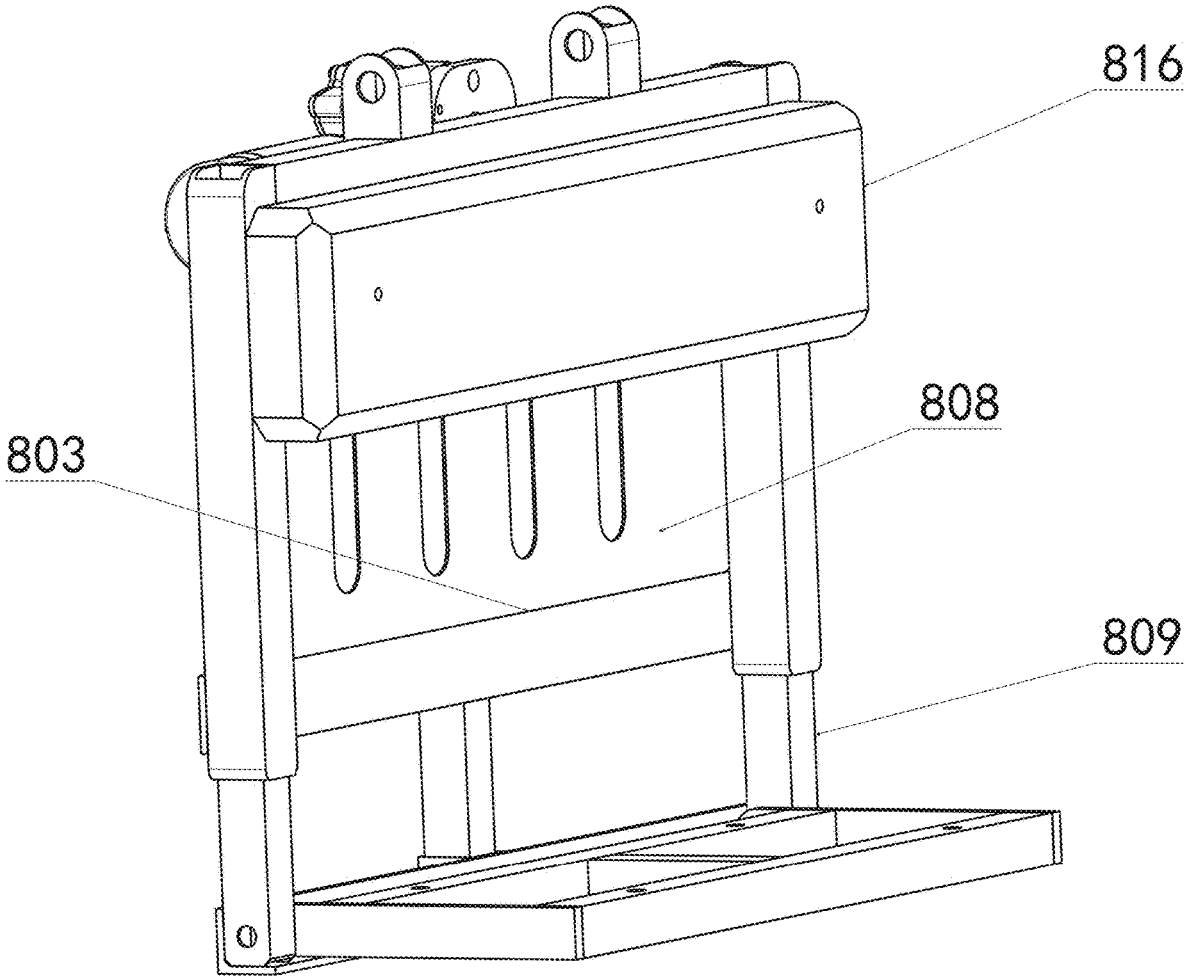
FIG. 18 is a perspective view of a legrest system, according to an embodiment.
Figure 19:
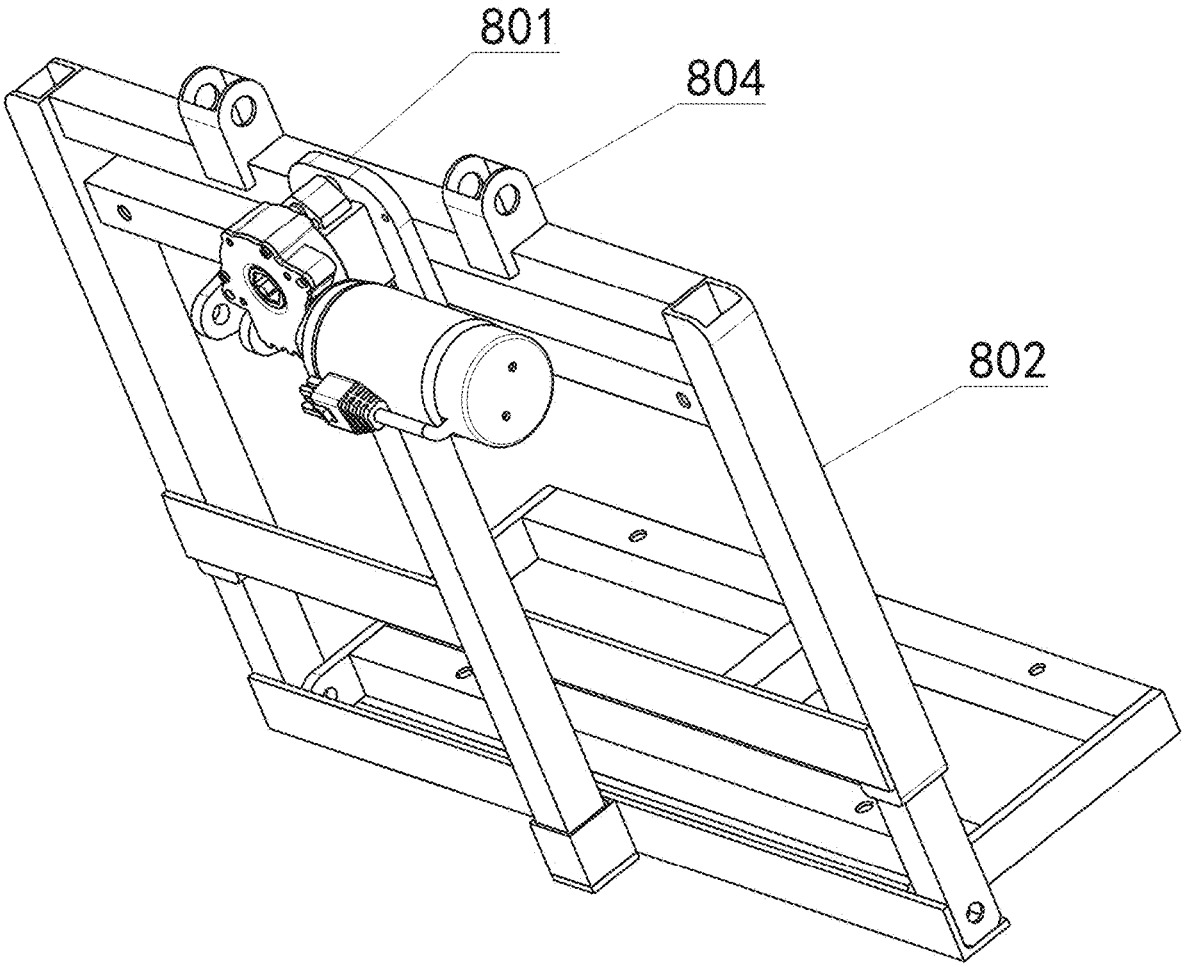
FIG. 19 is another perspective view of a legrest system, according to an embodiment.
Figure 20:
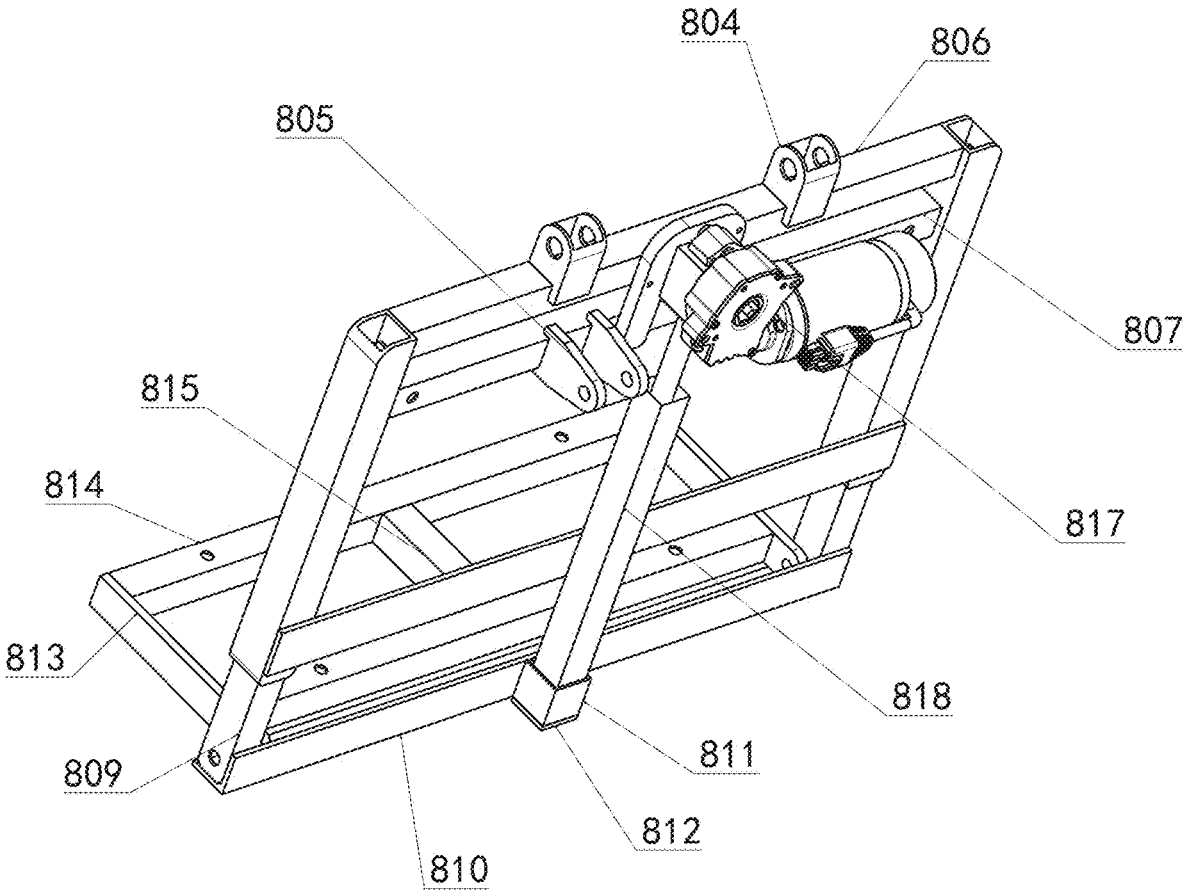
FIG. 20 is a back view of a legrest system, according to an embodiment.

100. Chassis
101. Chassis frame
102. Caster
103. Electric control box
200. Lifting fixed frame
201. Support beam
202. Supporting sub-frame
203. Lifting fixed column
204. Front extension beam
205. Rear extension beam
206. Lateral support beam
207. Nut
208. Lifting column connection block
300. Lifting and moving frame
301. Top longitudinal beam
302. Top longitudinal sub-beam
303. Lifting column
304. Lateral support sub-frame
305. longitudinal bottom support beam
306. backrest push rod motor end support plate
307. built-in connection block
308. Motor base
309. Lifting motor
310. Lead screw with gearbox
311. Seat flip push rod support shaft
312. Left and right power transmission shaft
313. Front and rear screw drive shafts
314. Armrest support shaft
315. Reinforcement rod
316. Seat flip push rod
317. Backrest flip push rod
400. angle adjustment frame
401. angle adjustment frame main beam
402. Seat moving push rod fixed support beam
403. Seat flip push rod ear plate
404. Ear plate support beam
405. Seat moving push rod
500. Seat moving frame
501. Moving frame main beam
502. Seat support beam
503. Leg support beam
504. Moving ear plate support beam
505. Friction plate
506. Secondary friction plate
507. Remove transition plate
508. Front reinforcement beam
509. Rear reinforcement beam
510. Moving lug plate
511. Leg support push rod fixing lug plate
512. Push rod shaft
513. Leg support connecting shaft
514. Seat cushion
515. Leg support flip push rod
600. Backrest frame
601. Lower backrest airbag cushion
602. Upper backrest cushion
603. Airbag headrest
604. Vertical backrest support beam
605. Backrest rotation axis
606. Armrest support rod
607. Horizontal reinforcement beam
608. Push rod ear plate at the flip end of the backrest
700. Armrest part
701. Vertical armrest support rod
702. Horizontal armrest support rod
703. Armrest plate
800. Legrest system
801. Motor push rod fixing plate
802. Legrest main frame support beam
803. Legrest main frame reinforcement plate
804. Rotation support beam
805. Leg support end push rod ear plate
806. Main cross brace of leg support main frame
807. Secondary cross brace of leg support main frame
808. Anti-snap plate
809. Main beam of leg support moving frame
810. Transverse reinforcement beam of leg support moving frame
811. Push rod moving end fixing sleeve
812. Push rod moving end fixing plate
813. Foot support plate
814. Transverse reinforcement beam of foot support
815. Intermediate reinforcement beam of foot support
816. Leg support pad
817. Push rod motor
818. Push rod While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION OF EMBODIMENTS

The embodiment of the present technology described herein are not intended to be exhaustive or to limit the technology to the precise forms disclosed in the following detailed description. Rather, the embodiment are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

Figure 21:
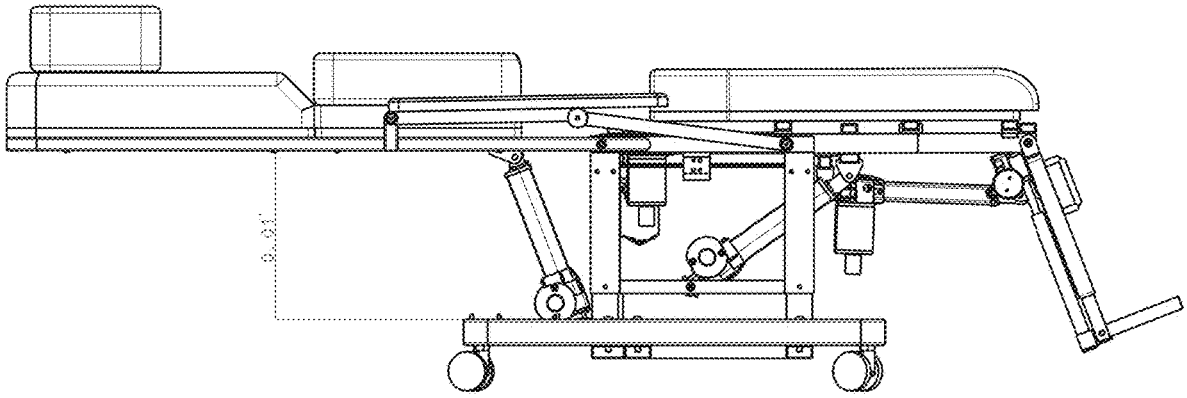
FIG. 21 is an alternate configuration in another perspective view thereof.
Figure 22:
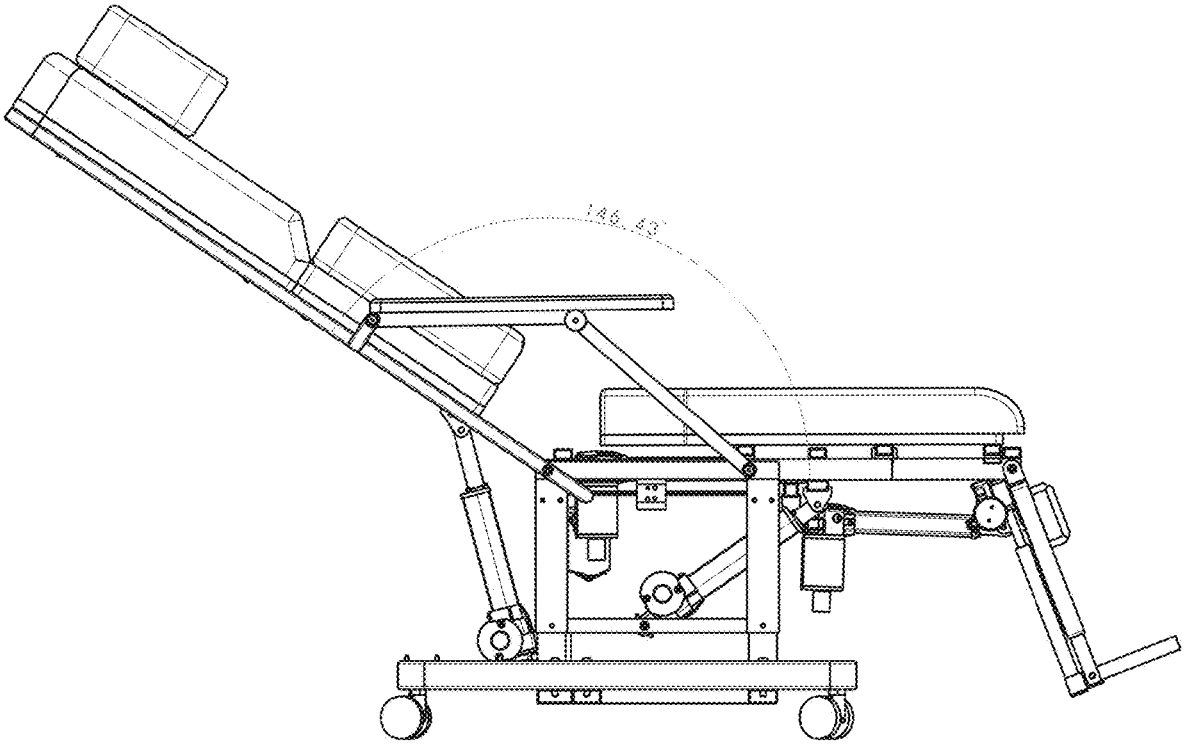
FIG. 22 is an alternate configuration in another perspective view thereof.
Figure 23:
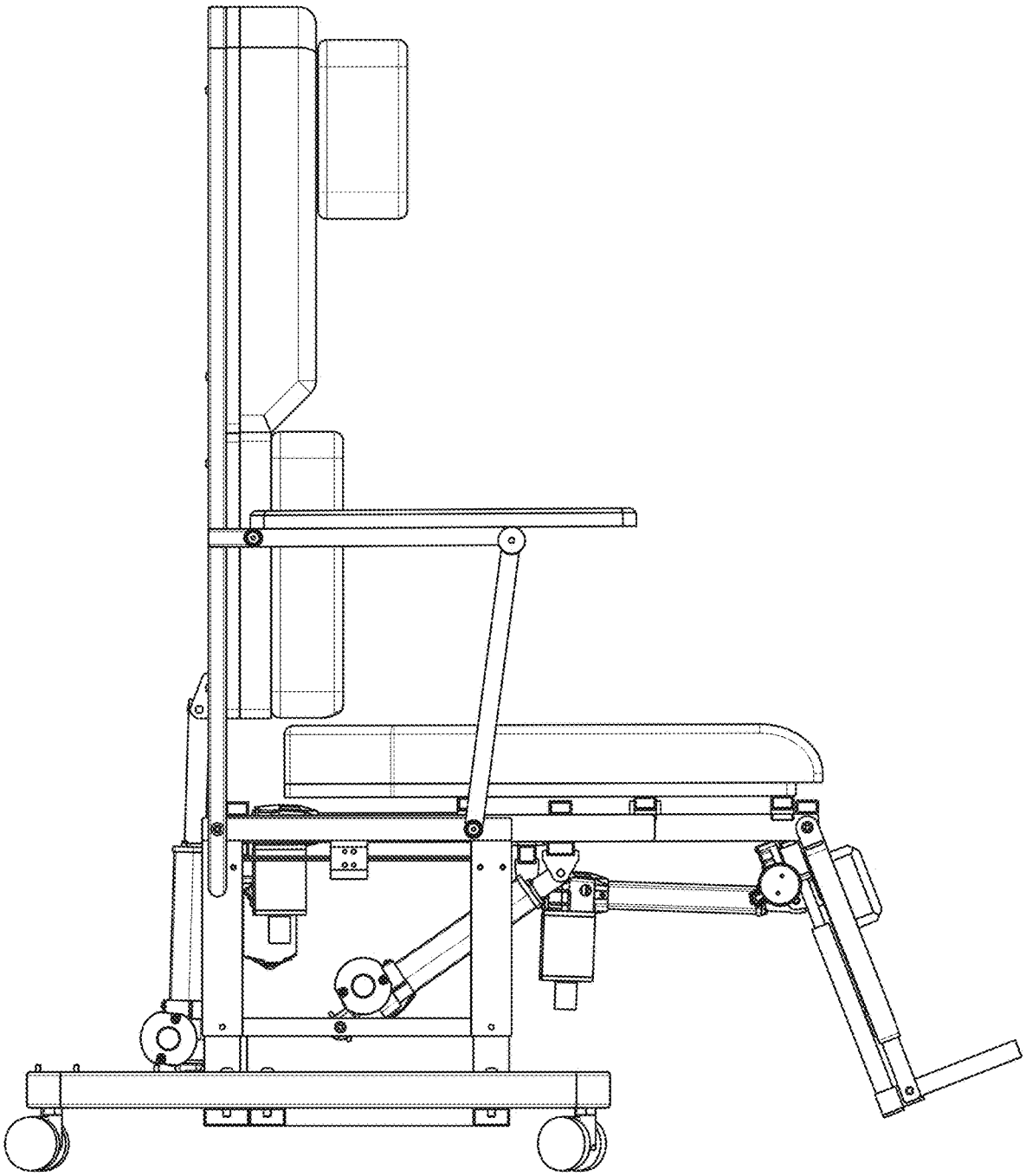
FIG. 23 is an alternate configuration in another perspective view thereof.

The way to adjust the angle of the backrest:

As shown in FIGS. 21-23, the specific method of backrest rotation, that is, tilting of the backrest frame (600) is as follows: the motor end of the built-in connection block 317 is connected to the backrest push rod motor end support plate 306 through an axis, and the push rod ear plate at the flip end of the backrest 608 through an axis. At the same time, the backrest frame 600 is connected to the lifting and moving frame 300 through the backrest rotation axis 605. When the push rod is extended or shortened, the backrest frame 600 rotates around the backrest rotation axis 605, thereby realizing the function of adjusting the backrest angle.

Figure 24:
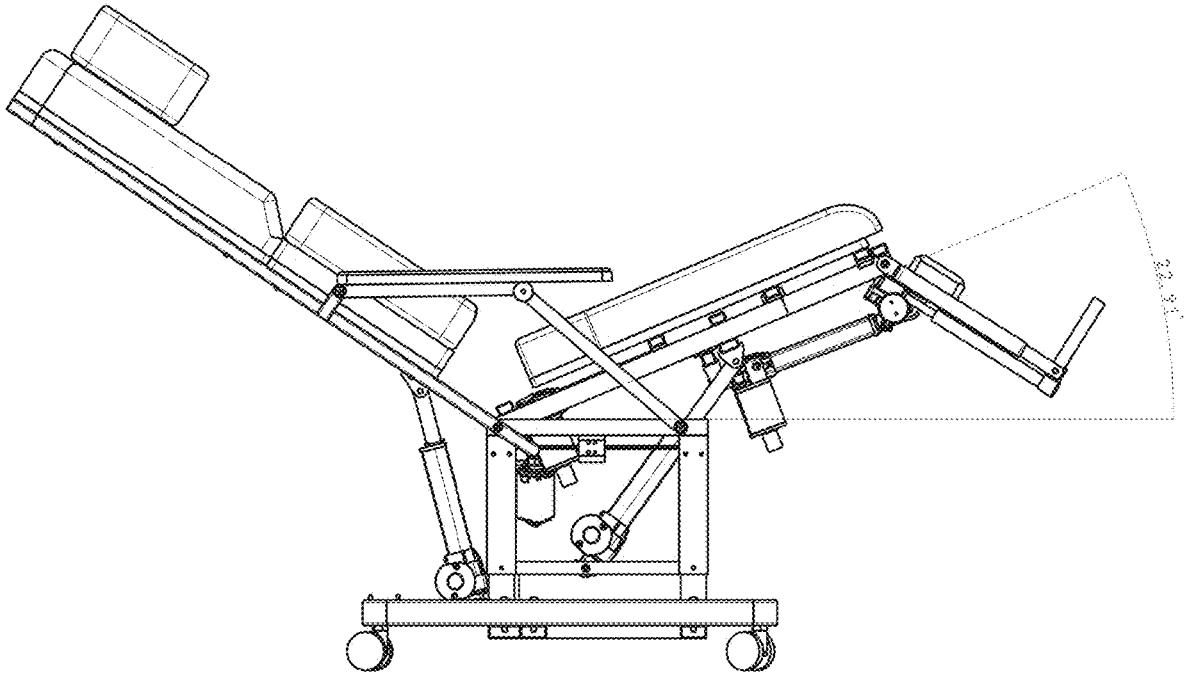
FIG. 24 is an alternate configuration in another perspective view thereof.

The way to adjust the angle of the seat:

As shown in FIGS. 22 and 24, the motor end of the seat flip push rod 316 is connected to the longitudinal bottom support beam 305 through the seat flip push rod support shaft 311, and the push rod end is connected to the seat flip push rod ear plate 403 through the shaft. At the same time, the angle adjustment frame 400 is connected to the lifting and moving frame 300 through the backrest rotation axis 605. When the push rod is extended or shortened, the angle adjustment frame 400 rotates around the backrest rotation axis 605, thereby realizing the function of adjusting the seat cushion angle. In order to achieve a compact structure, the backrest frame 600 and the angle adjustment frame 400 are both connected to the lifting and moving frame 300 through the backrest rotation axis 605.

Figure 29:
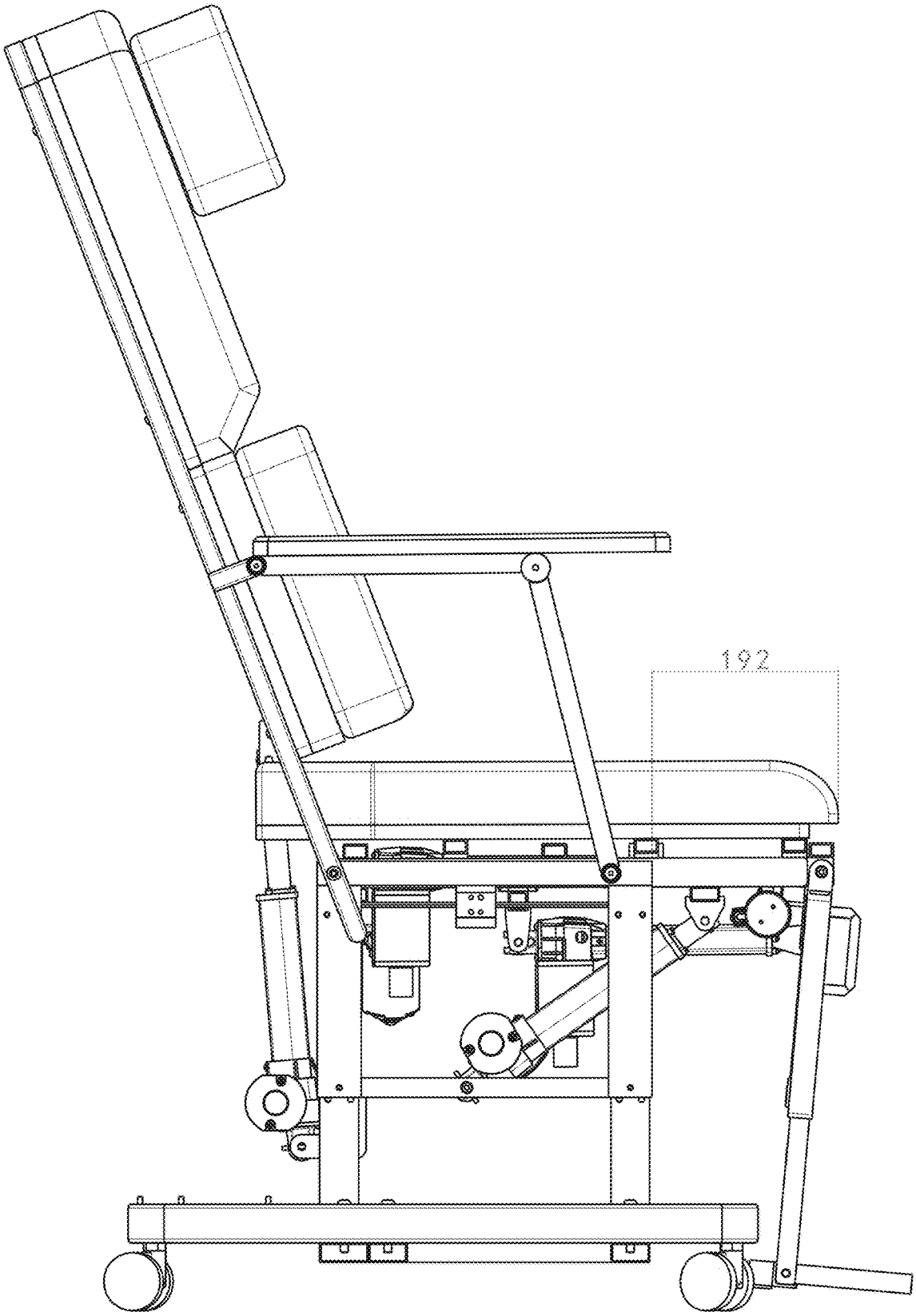
FIG. 29 is an alternate configuration in another perspective view thereof.
Figure 30:
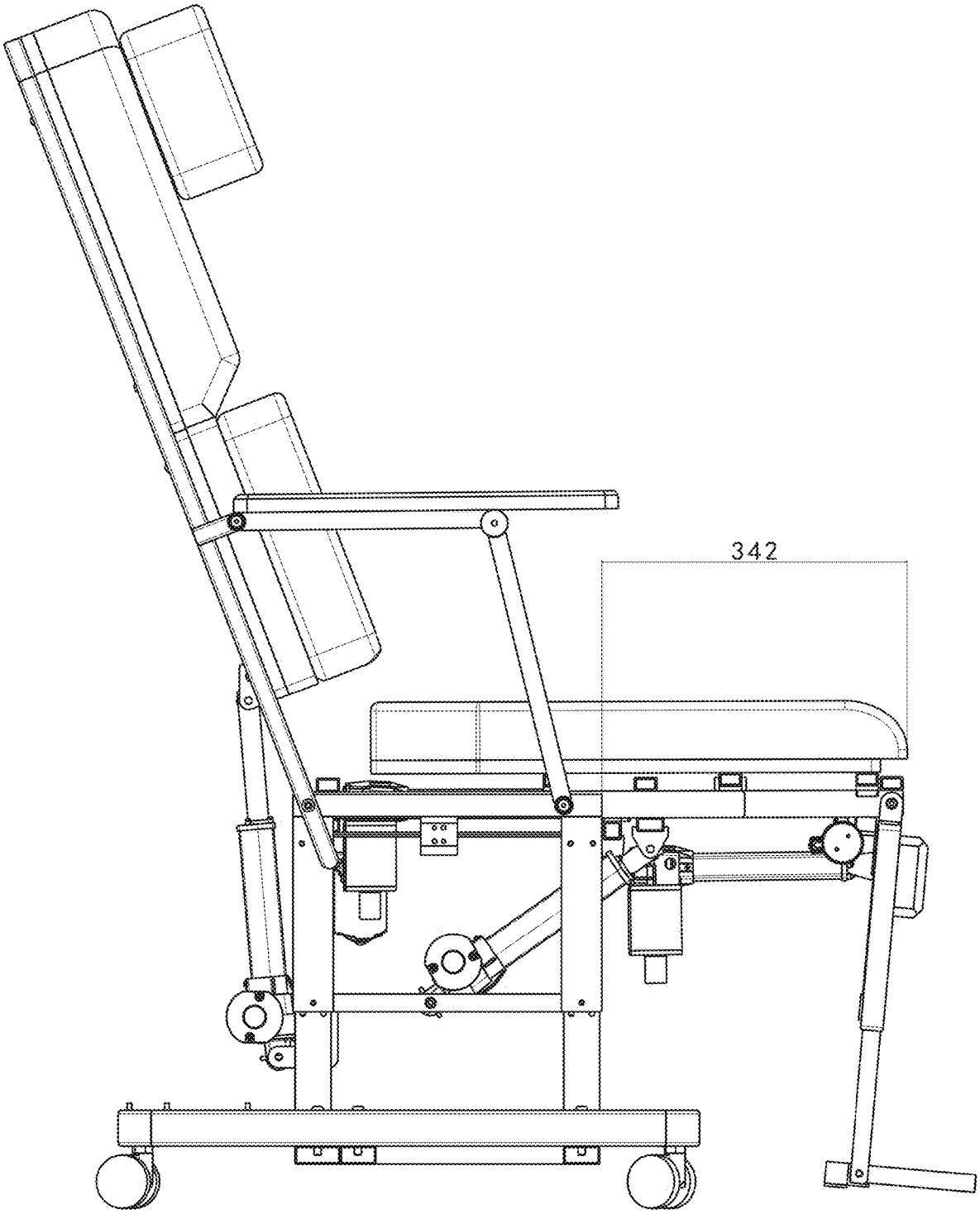
FIG. 30 is an alternate configuration in another perspective view thereof.

The way to adjust the length of the seat:

As shown in FIGS. 29 and 30, method of moving the cushion moving frame 500: The motor end of the seat moving push rod 405 is connected to the seat moving push rod fixed support beam 402 through a shaft, and the push rod end is connected to the moving lug plate 510 through a shaft. At the same time, the seat cushion moving frame 500 moves linearly along the angle adjustment frame 400. When the push rod is extended or shortened, the seat cushion moving frame 500 will move forward and backward along the angle adjustment frame 400, thereby realizing the function of adjusting the length of the seat cushion.

Figure 25:
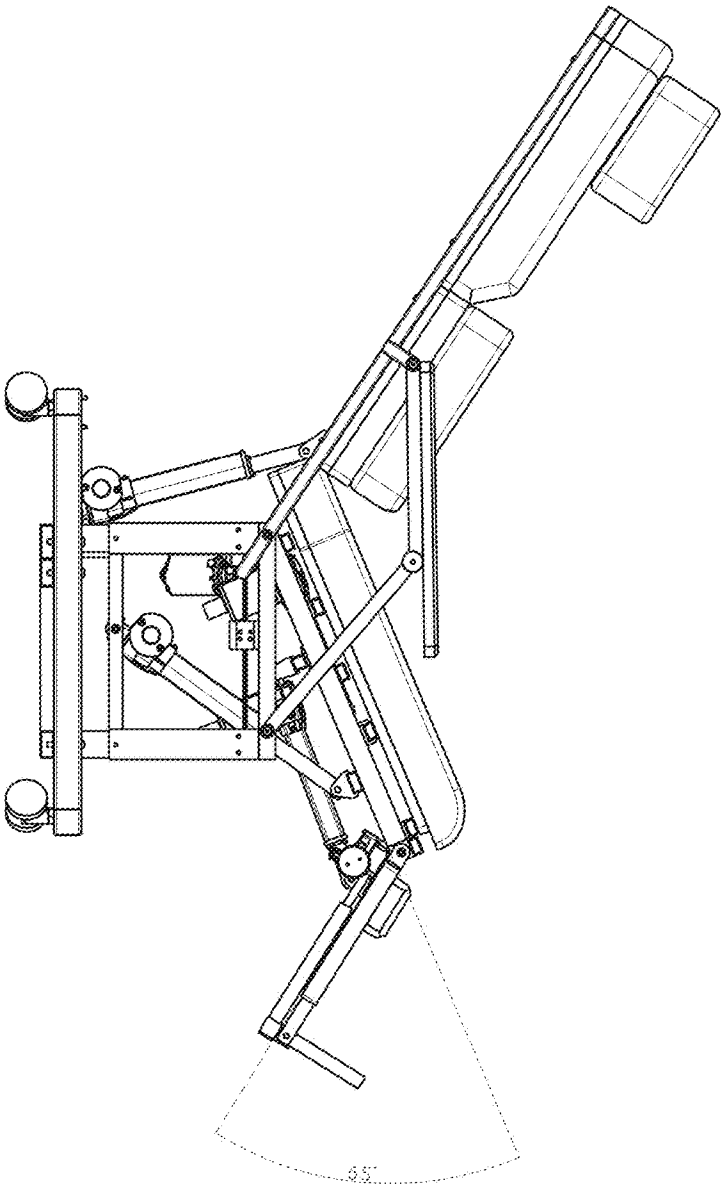
FIG. 25 is an alternate configuration in another perspective view thereof.
Figure 26:
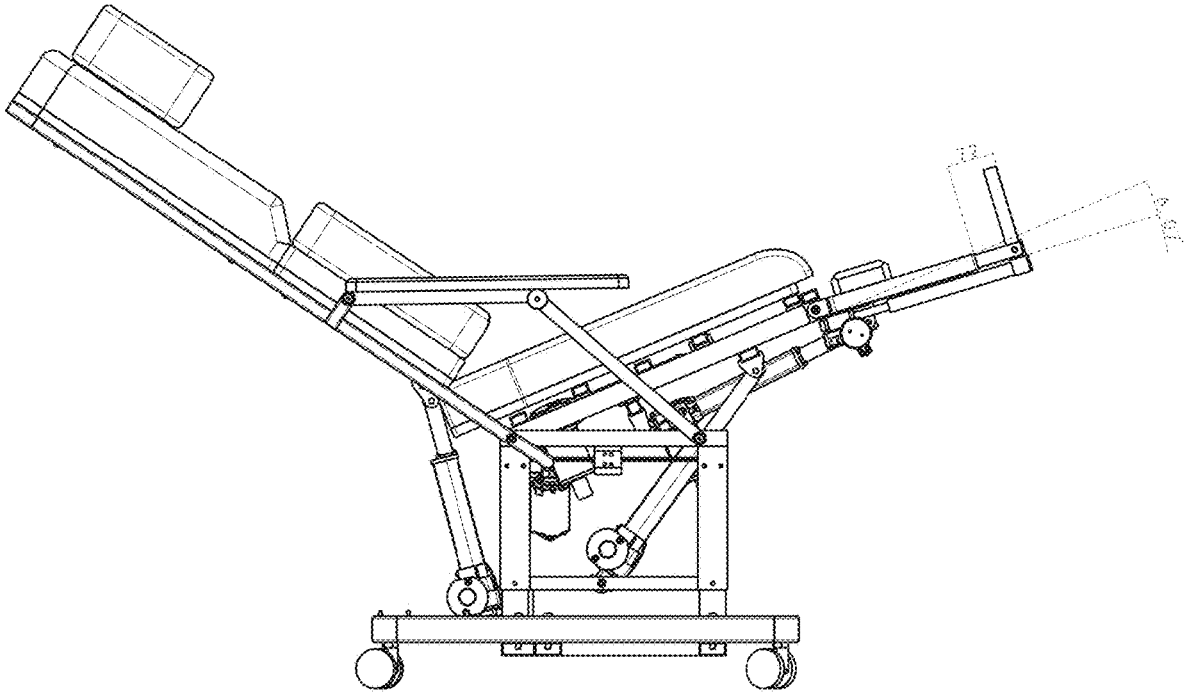
FIG. 26 is an alternate configuration in another perspective view thereof.

The way to adjust the angle of the leg support:

As shown in FIGS. 25 and 26, method of moving legrest system 800: the motor end of the leg support flip push rod 515 is connected to the leg support push rod fixing lug plate 511 through the push rod shaft 512, and the push rod end is connected to the leg support end push rod ear plate 805 through the shaft. At the same time, the legrest system 800 is connected to the seat moving frame 500 through the leg support connecting shaft 513. When the push rod is extended or shortened, the legrest system 800 rotates around the leg support connecting shaft 513, thereby realizing the function of adjusting the leg support angle.

Figure 27:
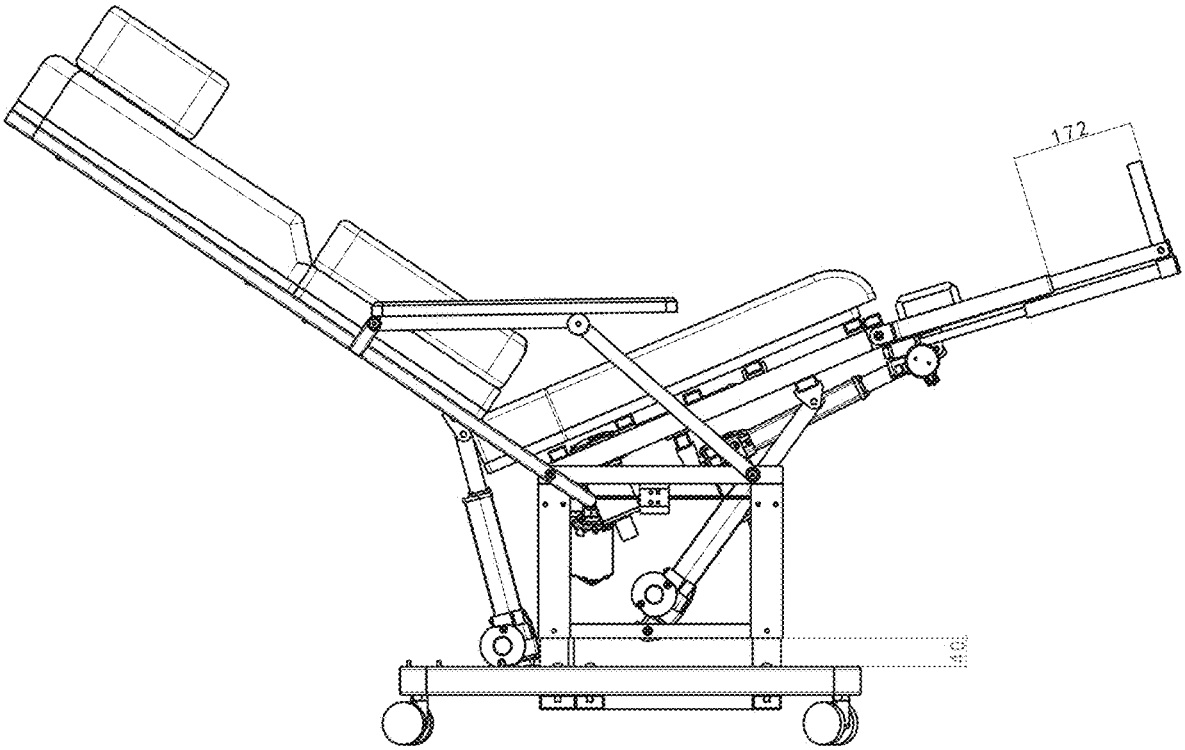
FIG. 27 is an alternate configuration in another perspective view thereof.

The way to adjust the length of the leg support:

As shown in FIGS. 26 and 27, the main beam of leg support moving frame 809 of the transverse reinforcement beam of leg support moving frame 810 of the leg support moving frame are welded together to form a moving frame. The push rod 818 is driven to move in the legrest main frame support beam 802 of the leg support main frame by the push rod motor 817 to drive the movement of the moving frame, thereby realizing the function of adjusting the length of the leg support.

Figure 28:
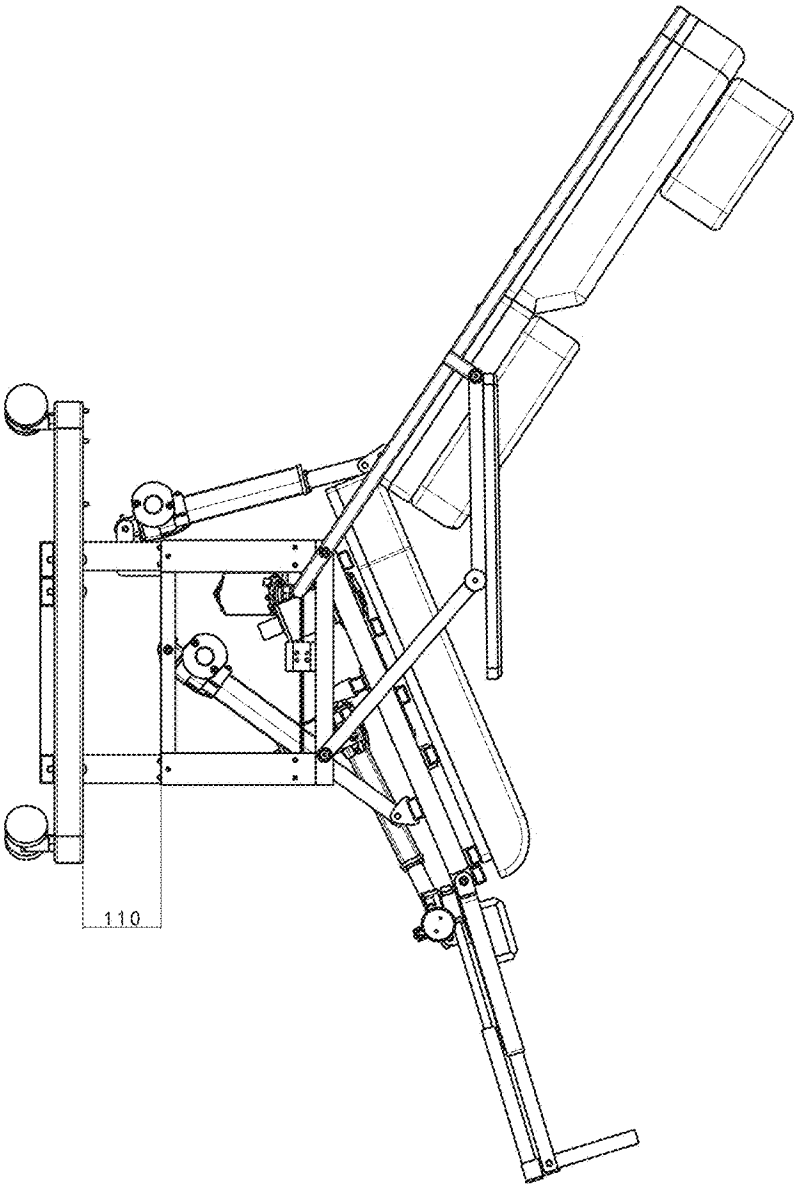
FIG. 28 is an alternate configuration in another perspective view thereof.

The way to adjust the height:

As shown in FIGS. 27 and 28, the method for lifting and lowering of the movable frame 300: The lifting motor 309 rotates clockwise to drive the front and rear screw drive shafts 313 to rotate. Under the drive of the left and right power transmission shaft 312, the four lead screws with gearbox 310 rotate simultaneously. The lead screws with gearbox 310 drive the nut 207 to move linearly downward. Since the nut 207 is fixed on the lifting fixed column 203, a reverse thrust is provided to push the lead screw with gearbox 310 to move upward. Since the lead screw with gearbox 310 are fixed on the top longitudinal beam 301 and the top longitudinal sub-beam 302, the lifting and moving frame 300 is driven to move upward. Conversely, the lifting and moving frame 300 is driven to move downward by the counterclockwise rotation of the lifting and moving frame 300.

Finally, the various postures of the chair are controlled by controlling the actions of the seat flip push rod 316, the backrest flip push rod 317, the leg support flip push rod 515, the lifting motor 309, and the push rod motor 817. The back and head are supported by inflating and deflation of the lower backrest airbag cushion 601 and the airbag headrest 603.

The invention claimed is:

1. A fully support electric chair, comprising a chassis, a lifting fixed frame, a lifting and moving frame, a flip frame an angle adjustment frame, seat moving frame, backrest frame, an armrest part and a legrest system; wherein the lifting fixed frame is fixed on the chassis; the lifting and moving frame is mounted on the lifting fixed frame and could be moved up and down; the backrest frame and the flip frame angle adjustment frame are connected to the lifting and moving frame through an axis, and are rotated around the axis at a certain angle under the push of an electric push rod; the seat moving frame is mounted on the flip frame angle adjustment frame and can slide forward and backward along the seat moving frame; the armrest part could be lowered or raised following the rotation of the backrest frame; the legrest system is connected to the seat moving frame through an axis; it can rotate to a certain angle under the action of the electric push rod and move forward and backward with the seat moving frame; the chair's entire structure allows for height adjustment, backrest flipping backrest angle adjustment, seat cushion flipping seat cushion angle adjustment, seat cushion moving forward and backward, and leg rest rotation; this enables the chair to accommodate different postures and meet the needs of various users;

wherein the lifting fixing frame consists of several components: a support beam, a supporting sub-frame, a lifting fixed column, a front extension beam, a rear extension beam, a lateral support beam, a nut, and a lifting column connection block; wherein the components are assembled as follows: the support beam, the supporting sub-beam, the front extension beam, the rear extension beam, and the lateral support beam are welded together to create a supporting frame; wherein the nut is placed on the top of the lifting fixed column, and the lifting column connection block is welded to the bottom of the lifting and fixed column, and then connected to the support beam; the front extension beam, and the rear extension beam using bolts, forming a bottom fixed supporting frame.

2. The fully support electric chair of claim 1, wherein the chassis consists of a chassis frame, casters, and an electric control box; the casters are mounted on the four corners of the chassis frame, and the electric control box is mounted on the chassis frame.

3. The fully support electric chair of claim 1, wherein the lifting and moving frame consists of various components such as a top longitudinal beam, a top longitudinal sub-beam, a lifting column, a lateral support sub-frame, a longitudinal bottom support beam, a backrest push rod motor end support plate, a built-in connection block, a motor base, a lifting motor, a lead screw with a gearbox, a seat flip push rod support shaft, left and right power transmission shafts, front and rear screw drive shafts, armrest support shaft, reinforcement rod, seat flip push rod, and backrest flip push rod; wherein the components are assembled in the following manner: the lifting column, the lateral support sub-frame, the longitudinal bottom support beam, and the reinforcement rod are welded into an integral support frame; wherein the built-in connection block is then installed on both sides of the upper end of the liftin column using bolts; wherein the top longitudinal beam and the top longitudinal sub-beam are connected to the inner seat; wherein the backrest push rod motor end support plate is welded to the lateral support sub-frame, and the motor base is installed on the lifting column; wherein the lifting motor is installed on the motor base, and the lead screw with gearbox is fixed to the top longitudinal beam and the top longitudinal sub-beam using bolts and then inserted into the lifting column; wherein the seat flip push rod support shaft passes through the seat flip push rod, and the motor end of the seat flip push rod is installed on the longitudinal bottom support beam; wherein the left and right power transmission shafts are connected to the front and rear screw drive shafts through the gearbox; wherein the front and rear screw drive shafts simultaneously pass through the lifting motor and the lead screw with the gearbox; wherein the armrest support shaft is respectively welded to the top longitudinal beam and the top longitudinal sub-beam, and one end of the backrest flip push rod is connected to the backrest push rod motor end support plate through the shaft.

4. The fully support electric chair of claim 1, wherein The flip frame angle adjustment frame consists of several components including a flip frame an angle adjustment frame main beam, a seat moving push rod fixed support beam, a seat flip push rod ear plate, a ear plate support beam, and a seat moving push rod; wherein the components are assembled in the following way: the flip frame angle adjustment frame main beam, the seat moving push rod fixed support beam, the seat flip push rod ear plate, and the seat moving push rod are welded together to form a frame; wherein the ear plate support beam is welded to the seat moving push rod.

5. The fully support electric chair of claim 1, wherein the seat moving frame comprises several key components: a moving frame main beam, a seat support beam; a leg support beam; a moving ear plate support beam; a friction plate; a secondary friction plate; a remove transition plate; a front reinforcement beam; a rear reinforcement beam; a moving lug plate; a leg support push rod fixing lug plate; a push rod shaft; a leg support connecting shaft; a seat cushion; leg support flip push rod; wherein the moving lug plate, the front reinforcement beam, and the rear reinforcement beam are welded into a support frame; wherein the seat support beam and the moving ear plate support beam are bolted through the friction plate installed on the moving frame main beam; wherein the remove transition plate is disassembled and welded to the leg support beam to form a detachable frame, and then connected to the moving frame main beam of the movable frame by bolts; wherein the secondary friction plate is installed on the leg support beam; wherein the moving lug plate is welded to the moving ear plate support beam; wherein the leg support push rod fixing lug plate is welded to the leg support beam; wherein the leg support connecting shaft passes through the front opening of the moving frame main beam; wherein the push rod shaft is installed in the middle of the leg support push rod fixing lug plate; wherein the seat cushion is installed on the seat support beam and the moving ear plate support beam; wherein the leg support flip push rod is installed on the push rod shaft.

6. The fully support electric chair of claim 1, wherein the backrest frame consists of several components: a lower backrest airbag cushion, an upper backrest cushion, an airbag headrest, a vertical backrest support beam, a backrest rotation axis, an armrest support rod, a horizontal reinforcement beam, and a push rod ear plate at the flip end of the backrest; wherein the vertical backrest support beam and the horizontal reinforcement beam are welded together to form a support frame; wherein the armrest support rod is welded to the vertical backrest support beam; wherein the lower backrest airbag cushion and the upper backrest cushion are installed on the support frame; wherein the airbag headrest is pressed onto the upper backrest cushion; wherein the backrest rotation axis is installed on the vertical backrest support beam, and the push rod ear plate at the flip end the backrest is welded to the lower backrest horizontal reinforcement beam.

7. The fully support electric chair of claim 1, wherein the legrest system consists of various components including a motor push rod fixing plate, a legrest main frame support beam, a legrest main frame reinforcement plate, a rotation support beam, a leg support end push rod ear plate, a main cross brace of leg support main frame, a secondary cross brace of leg support main frame, an anti-snap plate, a main beam of leg support moving frame, a leg support moving frame transverse reinforcement beam, a push rod moving end fixing plate, a push rod moving end fixing plate, a foot support plate, a transverse reinforcement beam of foot support, a intermediate reinforcement beam of foot support, a leg support pad, a push rod motor, and a push rod; wherein the legrest main frame reinforcement plate, the legrest main frame support beam, the main cross brace of leg support main frame, and the secondary cross brace of leg support main frame are welded to form a fixed frame; wherein the motor push rod fixing plate is installed on the fixed frame, and the push rod motor and the push rod head are installed on the motor push rod fixing plate; wherein the rotation support beam is welded to the main cross brace of leg support main frame, and the leg support end push rod ear plate is welded to the leg support main frame secondary cross bracing beam; wherein the anti-splint plate is welded to the legrest main frame support beam, and the main beam of leg support moving frame and the transverse reinforcement beam of leg support moving frame are welded together to form a mobile frame; wherein the push rod moving end fixing plate is welded to the head of the push rod moving end fixing sleeve; wherein the foot support plate, the transverse reinforcement beam of foot support, and the intermediate reinforcement beam of foot support are welded to form a foot frame, and the leg support pad is installed on the Secondary cross brace of leg support main frame.

* * * * *